US009811982B2

(12) United States Patent
Meyer

(10) Patent No.: US 9,811,982 B2
(45) Date of Patent: Nov. 7, 2017

(54) ELECTRONIC GAMING MACHINE AND GAMING METHOD

(71) Applicant: AINSWORTH GAME TECHNOLOGY LIMITED, Newington, NSW (AU)

(72) Inventor: Jason Meyer, Abbotsford (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 10 days.

(21) Appl. No.: 13/793,834

(22) Filed: Mar. 11, 2013

(65) Prior Publication Data

US 2014/0141857 A1 May 22, 2014

(30) Foreign Application Priority Data

Nov. 20, 2012 (AU) ..... 2012905078

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/3267; G07F 17/3213; G07F 17/3262; G07F 17/34
See application file for complete search history.

(56) References Cited

U.S. PATENT DOCUMENTS 6,186,894 B1 * 2/2001 Mayeroff ..... 463/20
7,530,894 B1 5/2009 Marks et al.
2002/0183105 A1 * 12/2002 Cannon ..... G07F 17/32 463/16
2005/0101379 A1 * 5/2005 Falconer ..... G07F 17/34 463/25
2008/0064480 A1 * 3/2008 Randall ..... G07F 17/32 463/20
2008/0076521 A1 * 3/2008 Little ..... 463/20
2009/0042652 A1 * 2/2009 Baerlocher ..... G07F 17/32 463/42
2010/0173694 A1 * 7/2010 Tsuchida ..... G07F 17/34 463/20
2010/0197385 A1 * 8/2010 Aoki ..... G07F 17/32 463/27
2011/0105218 A1 * 5/2011 Anderson ..... G07F 17/32 463/20
2011/0223986 A1 * 9/2011 Little ..... 463/20
2012/0077566 A1 * 3/2012 Schultz et al. ..... 463/20
2012/0122547 A1 * 5/2012 Aoki et al. ..... 463/20
2012/0282995 A1 * 11/2012 Allen et al. ..... 463/22
2013/0029749 A1 * 1/2013 Rucker ..... G07F 17/3267 463/20
2013/0184055 A1 * 7/2013 Schultz et al. ..... 463/20
2013/0184057 A1 * 7/2013 Bramble ..... 463/21

* cited by examiner

*Primary Examiner* — James S McClellan
*Assistant Examiner* — Kevin Carter
(74) *Attorney, Agent, or Firm* — Cook Alex Ltd.

(57) ABSTRACT

In an aspect, an electronic gaming machine includes an electronic game controller and a display for playing a plurality of games that are selectable for simultaneous play. Where one or more special symbols appear in a first game of the selected games, the electronic game controller applies one or more game enhancing elements that are associated with the special symbols to each of the selected games. In another aspect, the special symbols are associated with numerical values that are applied to each of the selected games. Gaming methods are also provided.

22 Claims, 17 Drawing Sheets

ELECTRONIC GAMING MACHINE AND GAMING METHOD

BACKGROUND

The present invention relates to an electronic gaming machine and in a particular an electronic gaming machine using a base game and a feature game. The invention has been developed primarily for use as an electronic gaming machine and will be described hereinafter by reference to this application.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

In an electronic gaming machine, the mechanical reels are replaced with video images of the reels, which are displayed on a video display screen. The electronic gaming machine has an internal electronic game controller, typically a computer, that controls the display of images on the video display screen so that the reels are visibly spun on the screen to simulate a physical reel of a traditional gaming machine. Electronic gaming machines are also more versatile in presenting game information, varying the probabilities for a player to win a prize and varying the type of game that is played.

Bonus or "feature" games may be provided by an electronic gaming machine in addition to the base or main game. Typically feature games use the same set of reels as the main game and are limited to a set of free games operated under a single set of rules. Once the free feature games have been played, the electronic gaming machine resets itself and returns the player back to the base game. This standard structure to game play limits the variation in the play of the electronic gaming machine. Consequently, it is difficult to retain player interest because there is no apparent incentive for the player to continue playing the same electronic gaming machine once the player becomes familiar with the feature game and the main game. Also, it is difficult to retain player interest since there is little differentiation between gaming machines in terms of the main and feature games that are played.

It is an object of the present invention to overcome or substantially ameliorate one or more of the disadvantages of prior art, or at least to provide a useful alternative.

It is an object of the invention in at least one preferred form to provide an electronic gaming machine and a method for controlling an electronic gaming machine that encourages player interest.

SUMMARY

According to a first aspect of the invention, there is provided an electronic gaming machine comprising:

a display for displaying a plurality of games, wherein each game comprises game symbols arranged into an array and where predetermined winning combinations of randomly selected game symbols in each game award prizes to a player, and an electronic game controller for controlling the display of game symbols on the display, wherein said player selects the number of said games that are simultaneously playable, said electronic game controller determining the appearance of one or more special symbols in a first game of said player-selected games, wherein said special symbols are associated with one or more game enhancing elements for enhancing said player-selected games, and the appearance of at least one special symbol in said first game causes said electronic game controller to apply the game enhancing element associated with said at least one special symbol to each of said player-selected games.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Preferably, said game enhancing element increases the value of any prizes awarded upon any predetermined winning combinations appearing in said player-selected games. More preferably, said gaming enhancing element comprises a numerical value and said increase being associated with said numerical value. In one preferred form, said gaming enhancing element comprises a multiplier symbol. In a particularly preferred form, said multiplier symbol comprises at least one of an all wins multiplier symbol which applies to all predetermined winning combinations, a wild multiplier symbol which applies to predetermined winning combinations that include the wild multiplier symbol and a wheel with two or more numerical values. Where the multiplier symbol comprises a wheel with two or more numerical values, the electronic game controller randomly selects one of the numerical values on said wheel for application to said player-selected games. In another preferred form, said game enhancing element comprises a free game symbol with an associated numerical value representing the number of additional free games awarded to said player, a symbol associated with a jackpot level value, a bonus prize value or other numerical enhancement of said prize(s).

Alternatively, said game enhancing elements comprise at least one or more of a second array, bonus prizes, collector symbols, bonus wilds, trigger symbols to retrigger the second array, held columns, random wild symbols, progressives, jackpot symbols, and one or more symbol replacements.

Where more than one special symbol appears in said first game, the game enhancing element associated with each special symbol is applied simultaneously to each of said player-selected games.

Preferably, said game enhancing element is immediately applied to any predetermined winning combinations in said player-selected games. More preferably, said game enhancing element is applied to said player-selected games for one or more subsequent plays of said player-selected games after an initial play of said first game in which said at least one special symbol has appeared. In one preferred form, said subsequent plays are consecutive. In another preferred form, said subsequent plays occur within a predetermined number of plays of said player-selected games. In a further preferred form, there is a predetermined number of said subsequent plays.

Preferably, the association of said game enhancing element with said player-selected games is indicated on said display.

Preferably, said initial play and said subsequent plays are consecutive. Alternatively, said initial play and said subsequent plays are within a predetermined set of plays of said game.

Preferably, said at least one of said plurality of games comprises first game comprises a base game and a feature game, wherein said one or more special symbols appear in said feature game. More preferably, said first game comprises a base game and a feature game. In one preferred form, each said game comprises a base game and a feature game, wherein said one or more special symbols appear in said feature game.

Alternatively, said game is a base game of said electronic gaming machine. In another alternative, said game is a feature game of said electronic gaming machine.

Preferably, said feature game comprises additional game symbols displayed adjacent to said array of said first game. More preferably, said array of said first game comprises an array of rows and columns and said additional game symbols are displayed as an extra row or column. In one preferred form, said game enhancing element is displayed in said extra row or column.

Preferably, the number of player-selected games is dependent on the amount wagered by said player. In one preferred form, the number of player-selected games is dependent on the number of pay lines that are wagered by said player.

Preferably, said electronic game controller randomly determines the appearance of said special symbols in said first game.

Preferably, in response to a trigger event, said electronic game controller causes the display of said special symbols in said first game. More preferably, said trigger event comprises said electronic game controller randomly generating a number and determining whether said randomly generated number is a predetermined number or within a predetermined range of numbers.

Alternatively, said trigger event comprises the appearance of at least one trigger symbol in said game. In one preferred form, said trigger event comprises the appearance of three trigger symbols.

Preferably, said trigger event comprises the appearance of at least one trigger symbol in said base game. More preferably, said trigger event causes said display to display game symbols for playing said feature game.

Preferably, said electronic game controller randomly determines the appearance of said at least one trigger symbol. In one preferred form, said at least one trigger symbol is substantially the same symbol as said special symbol.

Preferably, said special symbol may also act as another type of game symbol. More preferably, said special symbol may also act as at least one of a replacement symbol, a wild card symbol, a scatter symbol, bonus prizes, collector symbols, a win multiplier, wild multipliers, bonus wilds, random wild symbols, progressive symbols, bonus credits and jackpot symbols.

Preferably, said electronic game controller awards a random number of plays of said game in response to said trigger event. Alternatively, the number of plays of said game awarded by said electronic game controller in response to said trigger event depends of the amount wagered by the player.

Preferably, the same game symbols are used in said feature game and said base game. Alternatively, different game symbols or a mixture of the same and different game symbols are used in said feature game and said base game.

Preferably, said feature game has the same number of game symbols as said base game. Alternatively, said feature game and said base game have different numbers of game symbols.

Preferably, the game symbols in said feature game and said base game are organised or arranged in the same way. In another preferred form, the game symbols in said feature game and said base game are organised or arranged differently to each other.

Preferably, said game symbols in said feature game and said base game are arranged in arrays of the same shape or type. Alternatively, said game symbols in said feature game and said base game are arranged in differently shaped arrays. The shapes of said arrays are preferably rectangular, circular, triangular, oval, semi-circular or other non-rectangular shape.

Preferably, said electronic game controller causes the display of said feature game and said base game during play of said base game, said feature game being inactive until triggered. In this preferred form, the change in said feature game from being inactive to active may be indicated on the display. Alternatively, said electronic game controller causes the display of said feature game in response to said trigger event.

Preferably, said electronic game controller causes the display of said base game on a separate display to said display. Alternatively, said electronic game controller causes the display of said feature game and said base game on the same display.

Preferably, the electronic gaming machine comprises a mobile electronic gaming device. More preferably, said mobile electronic gaming device comprises a handheld electronic device. Alternatively, said electronic gaming machine comprises a computer. More preferably, said computer is connected to a communication network.

According to a second aspect of the invention, there is provided an electronic gaming machine comprising:

a display for displaying a plurality of games, wherein each game comprises game symbols arranged into an array and where predetermined winning combinations of randomly selected game symbols in each game award prizes to a player, and an electronic game controller for controlling the display of game symbols on the display, wherein said player selects the number of said games that are simultaneously playable, said electronic game controller determining the appearance of one or more special symbols in a first game of said player-selected games, wherein said special symbols are associated with one or more numerical values for enhancing said player-selected games, and the appearance of at least one special symbol in said first game causes said electronic game controller to apply the numerical value associated with said at least one special symbol to each of said player-selected games.

Preferably, said numerical value increases the value of any prizes awarded upon any predetermined winning combinations appearing in said player-selected games. More preferably, said increase is associated with said numerical value. In one preferred form, said increase is a multiple of said numerical value.

Preferably, where more than one special symbol appears in said first game, the numerical values associated with each special symbol are applied simultaneously to each of said player-selected games. More preferably, said numerical values simultaneously apply to increase the value of any prizes awarded upon any predetermined winning combinations appearing in said player-selected games.

Preferably, the association of said numerical value with said player-selected games is indicated on said display.

Preferably, said numerical value is applied to said player-selected games for one or more subsequent plays of said player-selected games after an initial play of said first game in which said at least one special symbol has appeared.

Preferably, said electronic gaming machine also comprises the preferred features of the first aspect of the invention stated above, where applicable.

According to a third aspect of the invention, there is provided a gaming method for an electronic gaming machine comprising a display and an electronic game controller, the method comprising the steps of:

controllably displaying game symbols for playing a plurality of games, where predetermined winning combinations of randomly selected game symbols in each said game results in the award of prizes to a player, said game symbols being arranged in an array;

said player selecting the number of said games that are simultaneously playable;

determining the appearance of one or more special symbols in a first game of said player-selected games, wherein said special symbols are associated with one or more game enhancing elements for enhancing said player-selected games, and wherein, upon the appearance of at least one special symbol in said first game, applying the game enhancing element associated with said at least one special symbol to each of said player-selected games.

Preferably, said applying step further comprises increasing the value of any prize awarded upon a predetermined winning combination appearing in said player-selected games. More preferably, said game enhancing element comprises a numerical value and said applying step comprises associating said prize value with said numerical value. In one preferred form, said applying step further comprises multiplying said prize value by said numerical value associated with said special symbol.

Preferably, wherein more than one special symbol appears in said first game, said applying step further comprises applying the game enhancing elements associated with each special symbol simultaneously to each of said player-selected games.

Preferably, said applying step further comprises immediately applying said game enhancing element to any predetermined winning combinations in said player-selected games.

Preferably, said applying step further comprises applying said game enhancing element to said player-selected games for one or more subsequent plays of said player-selected games after an initial play of said first game in which said at least one special symbol has appeared.

Preferably, the method further comprises indicating the association of said game enhancing element with said player-selected games on said display.

Preferably, said first game comprises a base game and a feature game, wherein said one or more special symbols appear in said feature game, said method further comprising displaying additional game symbols adjacent to said array of said first game.

Preferably, said array of said first game comprises an array of rows and columns, said method further comprising displaying said additional game symbols as an extra row or column, and also displaying said game enhancing element in said extra row or column.

Preferably, said determining step comprises randomly determining the appearance of said special symbols in said first game.

Preferably, said determining step further comprises determining the appearance of said special symbols in response to a trigger event. More preferably, said trigger event comprises the preferred features of the first aspect of the invention.

The method preferably has the preferred features of the first aspect of the invention stated above, where applicable.

According to a fourth aspect of the invention, there is provided there is provided a gaming method for an electronic gaming machine comprising a display and an electronic game controller, the method comprising the steps of:

controllably displaying game symbols for playing a plurality of games, where predetermined winning combinations of randomly selected game symbols in each said game results in the award of prizes to a player, said game symbols being arranged in an array;

said player selecting the number of said games that are simultaneously playable;

determining the appearance of one or more special symbols in a first game of said player-selected games, said special symbols being associated with one or more numerical values for enhancing said player-selected games, and wherein, upon the appearance of at least one special symbol in said first game, applying the numerical value associated with said at least one special symbol to each of said player-selected games.

Preferably, said applying step further comprises increasing the value of any prize awarded upon a predetermined winning combination appearing in said player-selected games. More preferably, said applying step comprises associating said prize value with said numerical value. In one preferred form, said applying step further comprises multiplying said prize value by said numerical value associated with said special symbol.

Preferably, where more than one special symbol appears in said first game, said applying step further comprises applying the numerical values associated with each special symbol simultaneously to each of said player-selected games.

Preferably, said applying step further comprises applying said numerical value to said player-selected games for one or more subsequent plays of said player-selected games after an initial play of said first game in which said at least one special symbol has appeared.

Preferably, said first game comprises a base game and a feature game, wherein said one or more special symbols appear in said feature game. More preferably, said first game comprises a base game and a feature game, wherein said one or more special symbols appear in said feature game, said method further comprising displaying additional game symbols adjacent to said array of said first game. In one preferred form, said array of said first game comprises an array of rows and columns, said method further comprising displaying said additional game symbols as an extra row or column. In another preferred form, the method comprises also displaying said game enhancing element in said extra row or column.

Preferably, the method further comprises indicating the association of said numerical value with said player-selected games on said display.

Preferably, said gaming method also comprises the preferred features of the second or third aspects of the invention stated above, where applicable.

According to a fifth aspect of the invention, there is provided a computer system comprising a central processing unit configured for communication with an electronic gaming machine, wherein said computer system is configured to perform the method of the third or fourth aspects of the invention.

According to a sixth aspect of the invention, there is provided a computer program configured to perform the method of the third or fourth aspects of the invention.

According to a seventh aspect of the invention, there is provided a non-transitive carrier medium carrying computer executable code that, when executed on a central processing unit configured for communication with an electronic gaming machine, causes the central processing unit to perform the method of the third or fourth aspects of the invention.

BRIEF DESCRIPTION OF THE DRAWINGS

Preferred embodiments of the invention will now be described, by way of example only, with reference to the accompanying drawings in which.

DETAILED DESCRIPTION OF THE VARIOUS EMBODIMENTS

Figure 1:
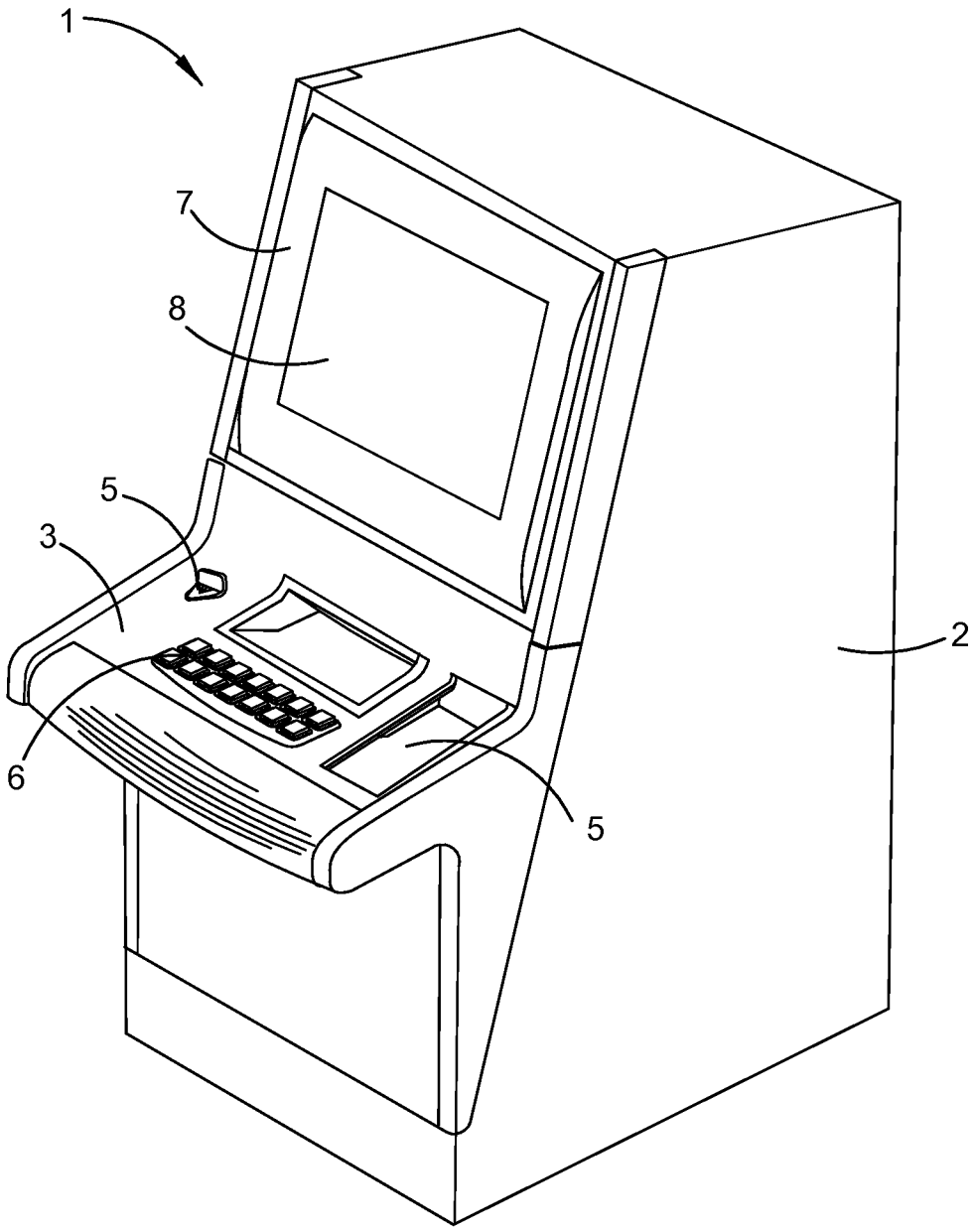
FIG. 1 is a perspective view of an electronic gaming machine according to an embodiment of the invention.
Figure 2:
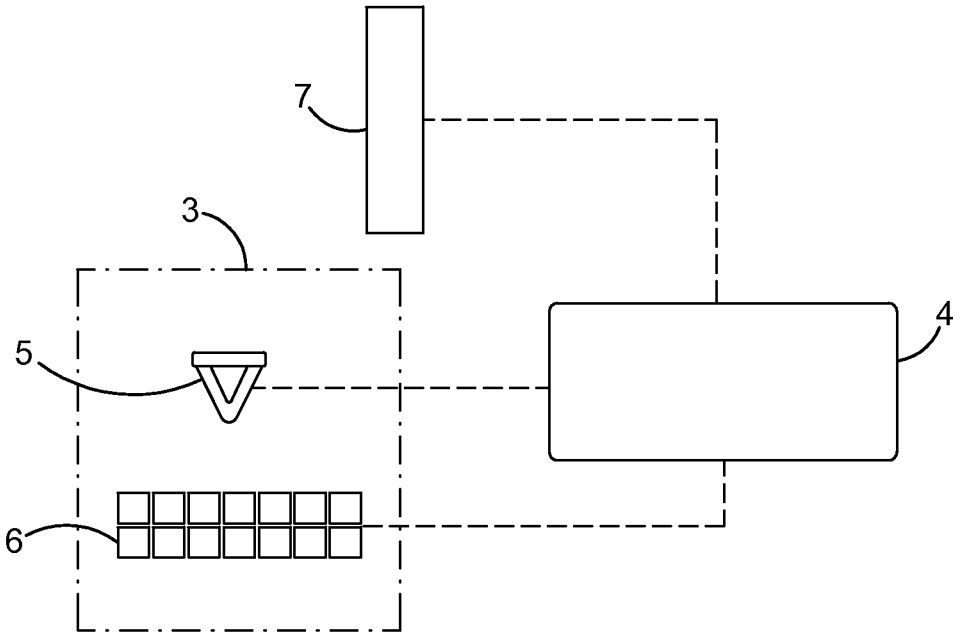
FIG. 2 is a schematic drawing of an electronic game controller for the electronic gaming machine of FIG. 1.

Referring to FIG. 1, an electronic gaming machine 1 according to a first embodiment of the invention includes a cabinet 2, a console 3 and an internal electronic game controller 4. The console 3 has various input devices including vending slots 5 for receiving monetary bets and a plurality of buttons 6 for actuation by a player. The electronic game controller 4 is generally in the form of a central processing unit, such as a computer, and is in electronic communication with a display in the form of a top display screen 7*a* and a bottom display screen 7*b*, as well as various input devices on the console 3, as best shown in FIG. 2. It is also appreciated that a person skilled in the art would readily understand the location and use of the electronic game controller 4 in the electronic gaming machine 1.

Figure 3:
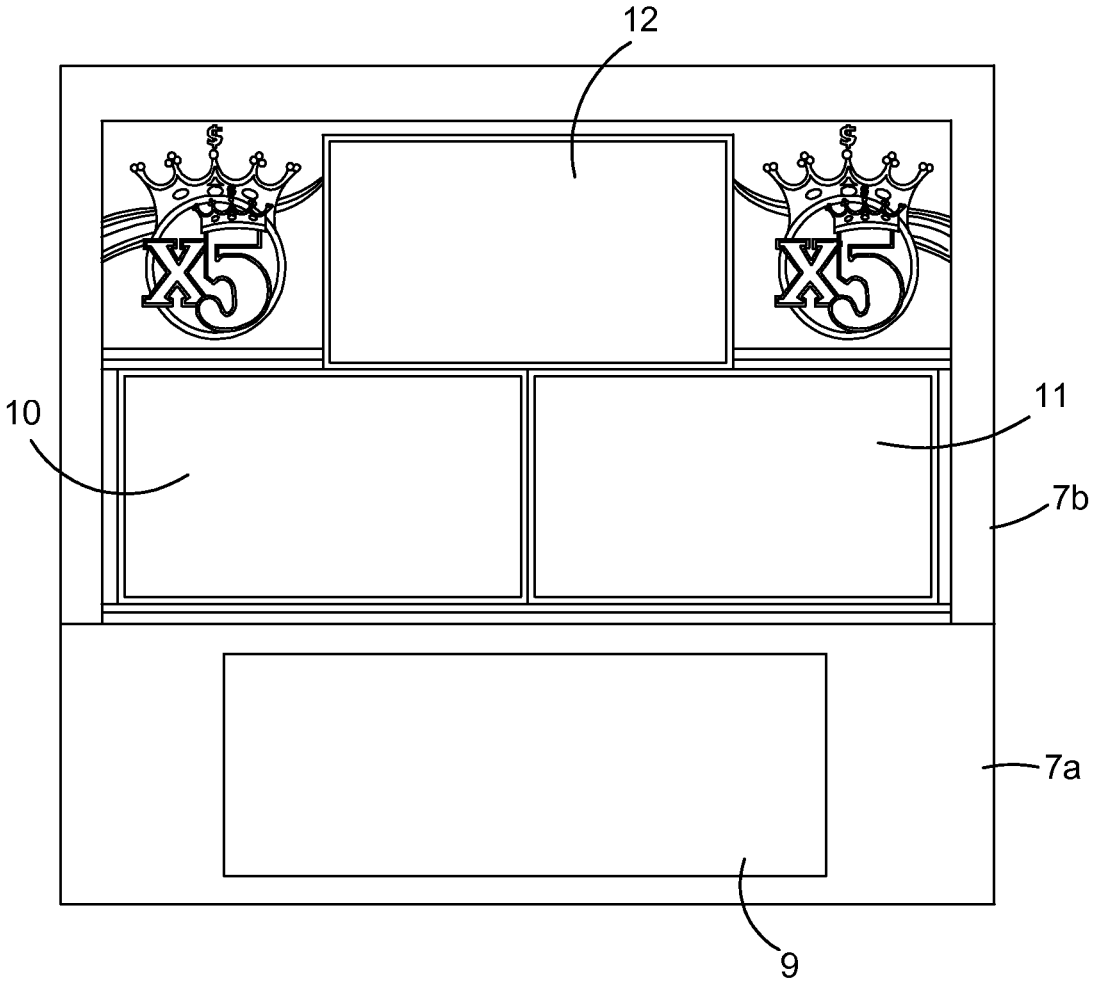
FIG. 3 is a schematic drawing illustrating a plurality of games to be played on the electronic gaming machine of FIG. 1, and FIGS. 4 to 17 are schematic drawings illustrating the playing of the plurality of games on the electronic gaming machine of FIG. 1.

The top and bottom display screens 7*a*, 7*b* are used to display game symbols 8 for playing a plurality of games in the form of base or main games 9, 10, 11 and 12, with a primary base game 9 being shown on the bottom display screen 7*b* and the other base games 10, 11, 12 being shown on the top display screen 7*a*, as best shown in FIG. 3. In addition, a feature game 13, 14, 15 and 16 for base games 9, 10, 11, 12, respectively, can also be displayed on the display screens 7*a*, 7*b* on the electronic gaming machine 1, as best shown in FIG. 3. A player inserts a monetary amount into the electronic gaming machine 1 and selects an initial bet to initiate play of the primary base game 9. In this embodiment, the invention is implemented as a group of games under the name "King Spin".

The top display screen 7*b* may also display related game information about the electronic gaming machine 1, including any jackpot information. The top display screen 7*b* may either integrated with bottom display screen 7*a* to form a single display 7 or be a physically separate display mounted above display screen 7*a*.

Figure 4:
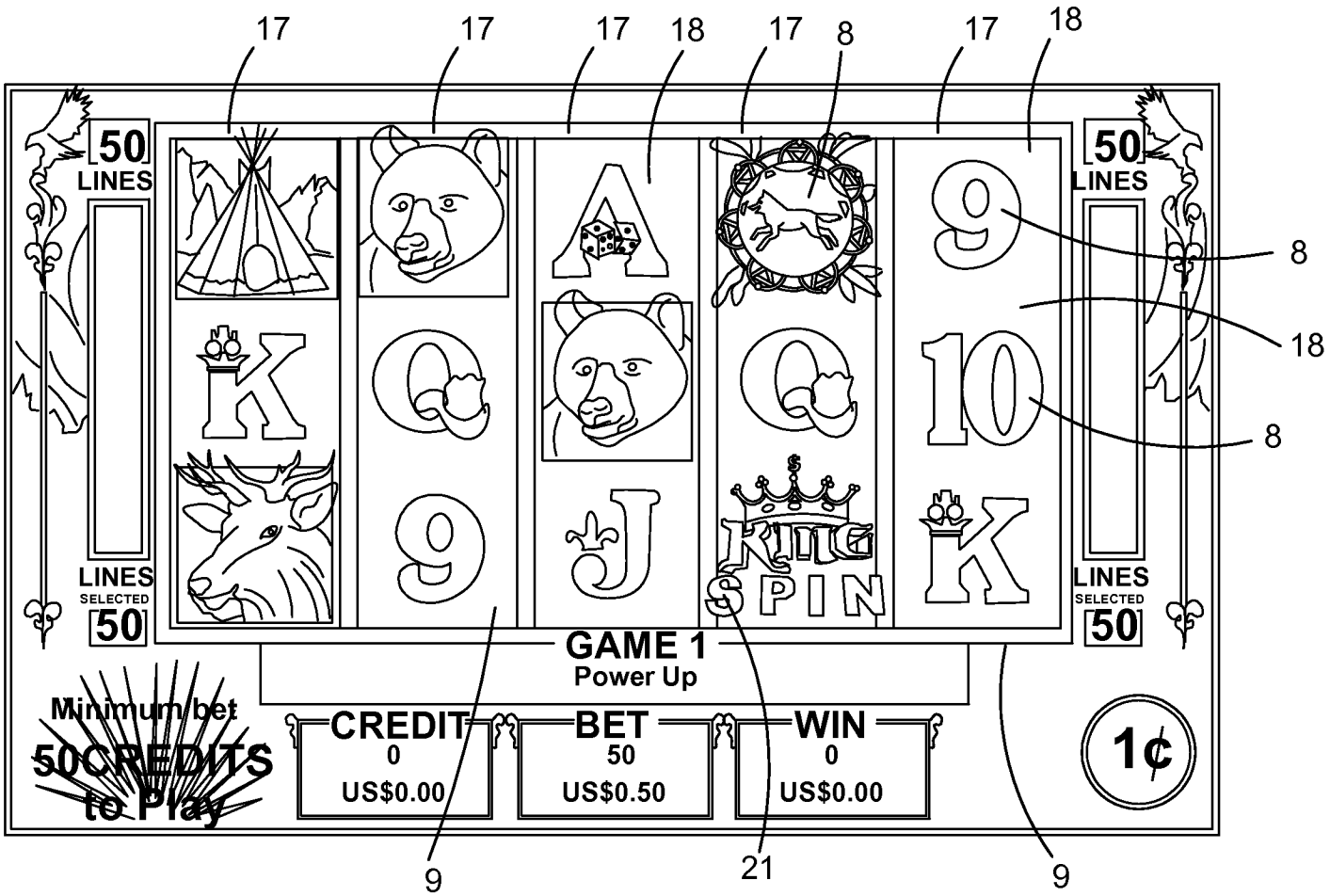
Figure 5:
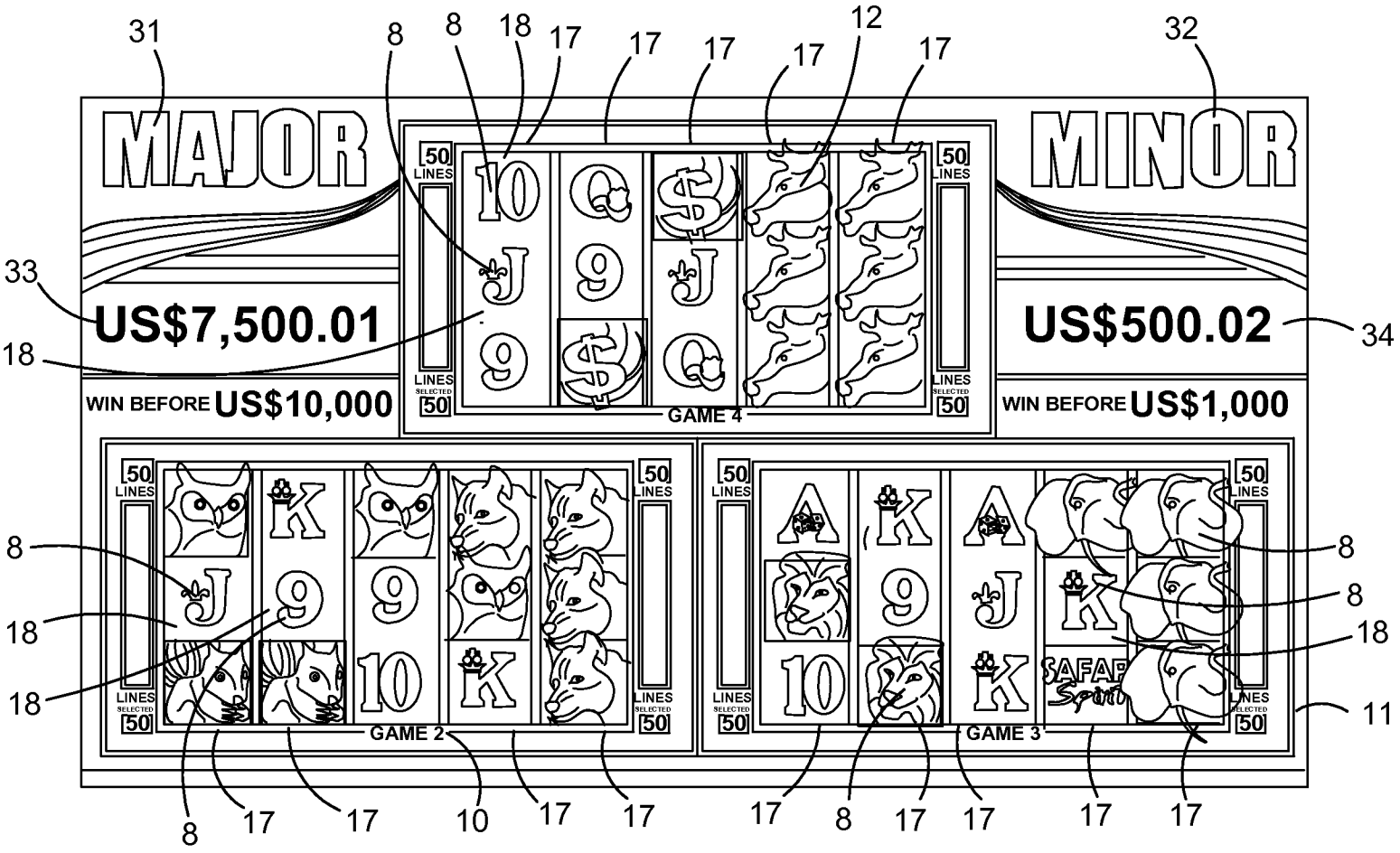

As best shown in FIGS. 4 and 5, in each of the base games 9, 10, 11, 12 the game symbols 8 are arranged in the form of five columns or "reels" 17, each having three visible positions or cells 18. The cells 18 can be considered to define the rows of each reel 17. Thus, the base games 9, 10, 11, 12 are in a standard 5×3 array common in the industry. However, if will be appreciate that the arrays for the base games 9, 10, 11, 12 and their counterpart feature games 13, 14, 15, 16 are not necessarily limited to this standard array format, and can include more or less rows and/or columns of cells 18, and even have uneven numbers of cells 18 in the rows and/or columns.

Figure 15:
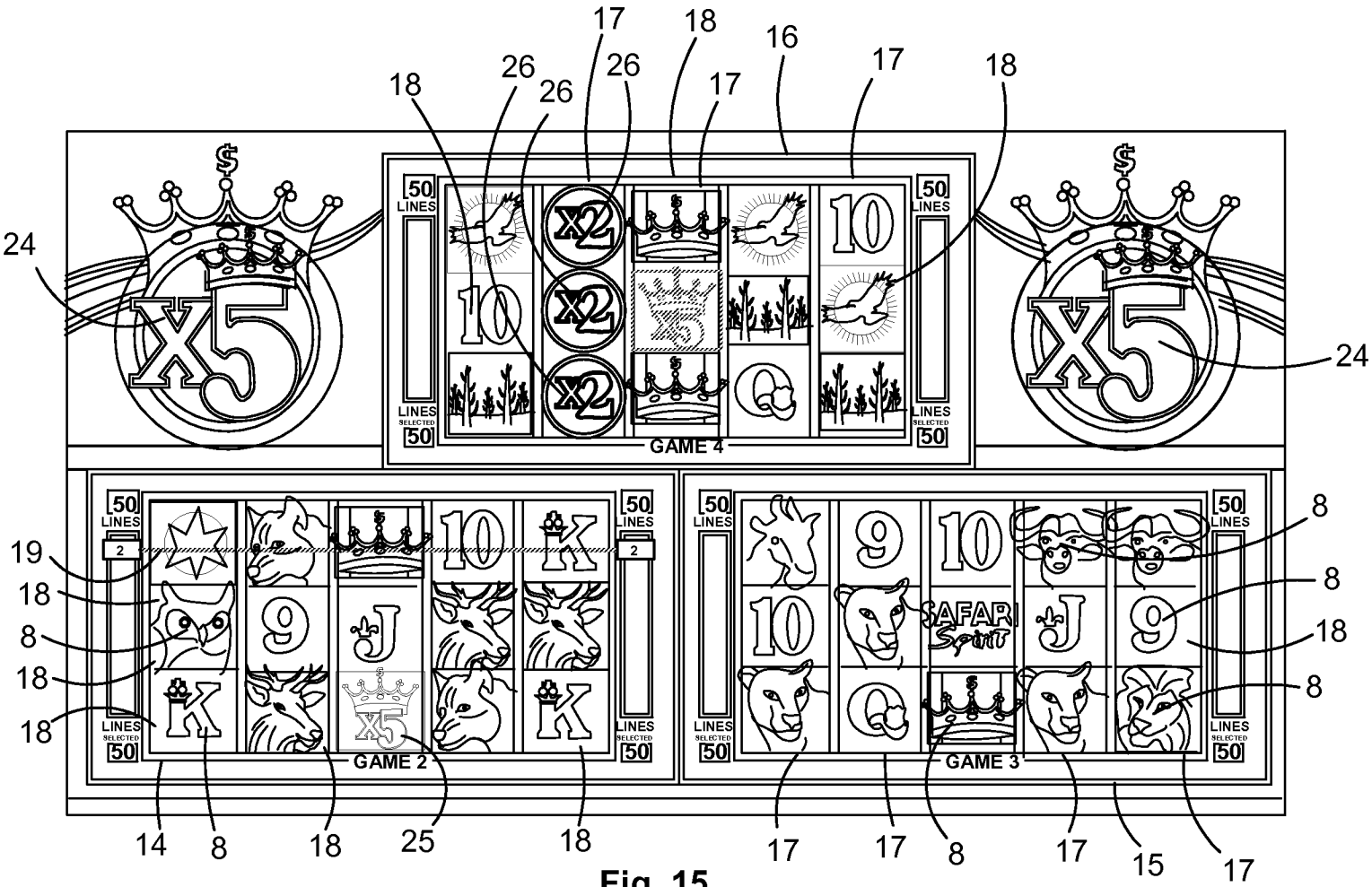
Figure 17:
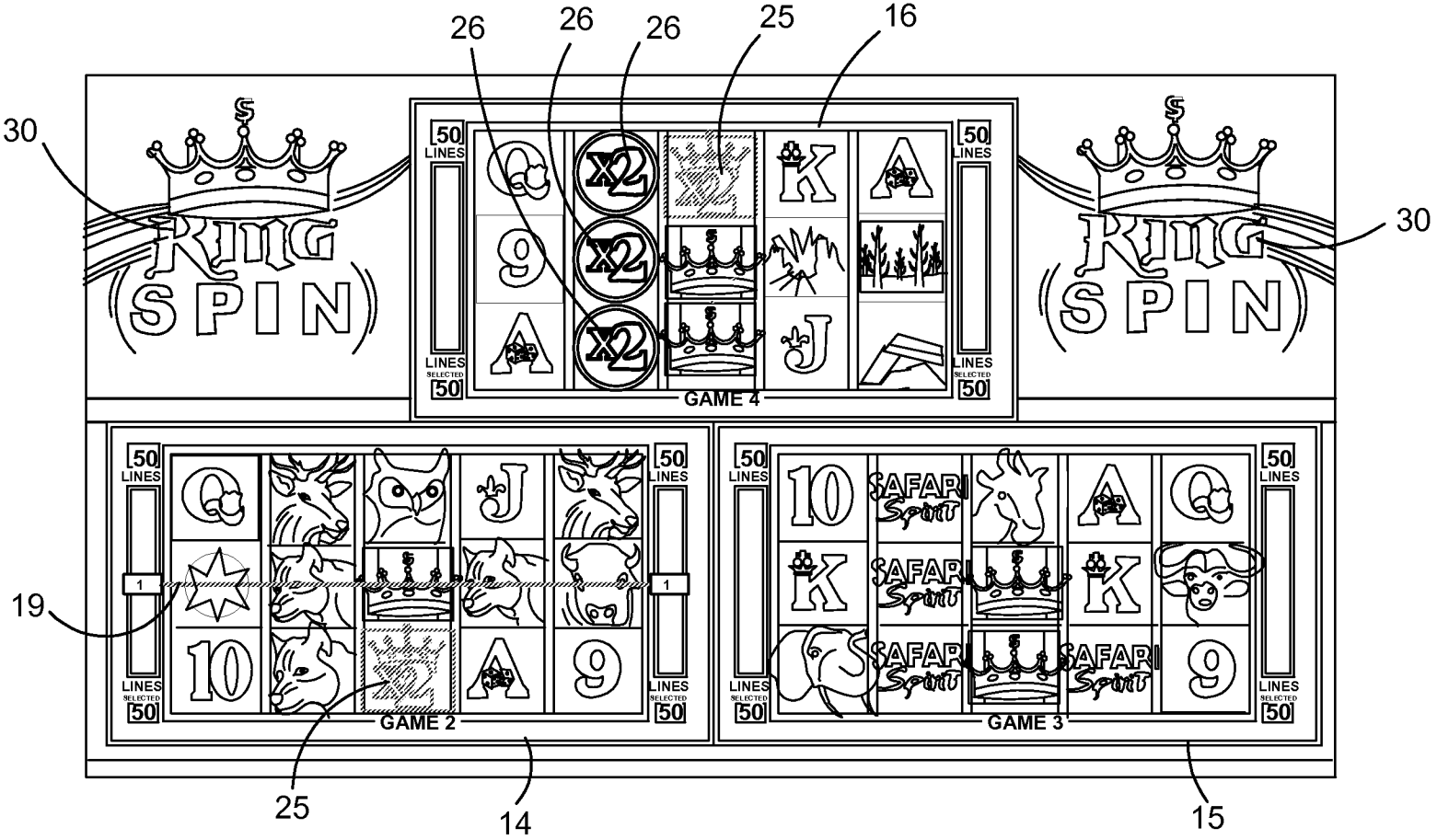

The game symbols 8 typically include picture symbols, wild symbols, scatter symbols and card symbols. Predetermined winning combinations of randomly selected game symbols 8 in each of the base games 9, 10, 11, 12 result in the award of prizes to the player. These predetermined combinations are typically in the form of pay lines 19 that have at least one game symbol 8 from each reel 17, as best shown in FIGS. 15 and 17.

The electronic game controller 4 controls the display of the game symbols 8 in each of the base games 9, 10, 11, 12 so that the base games are able to be played simultaneously. In other words, the reels 17 of each base game 9, 10, 11, 12 spin at the same time.

Figure 6:
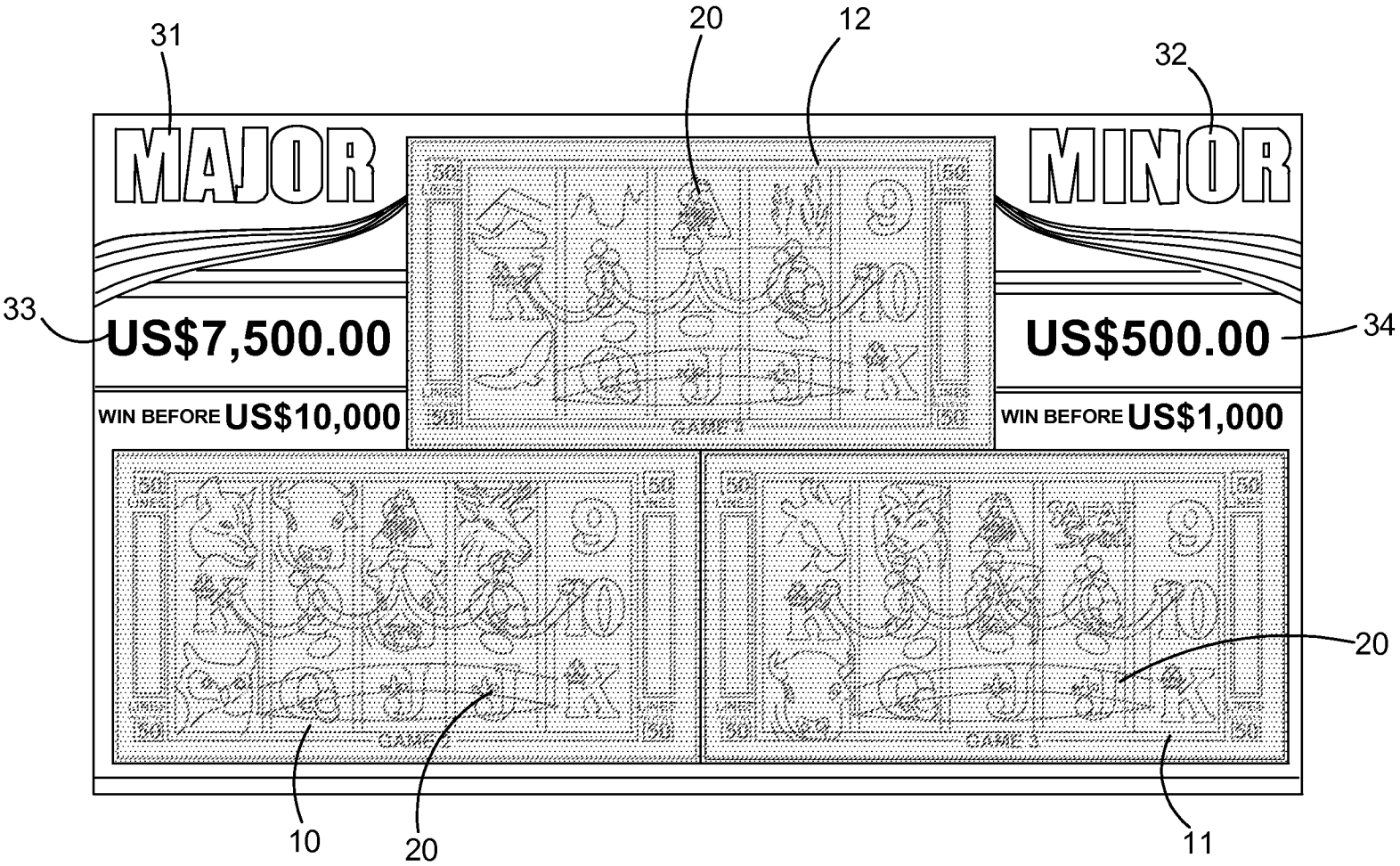
Figure 7:
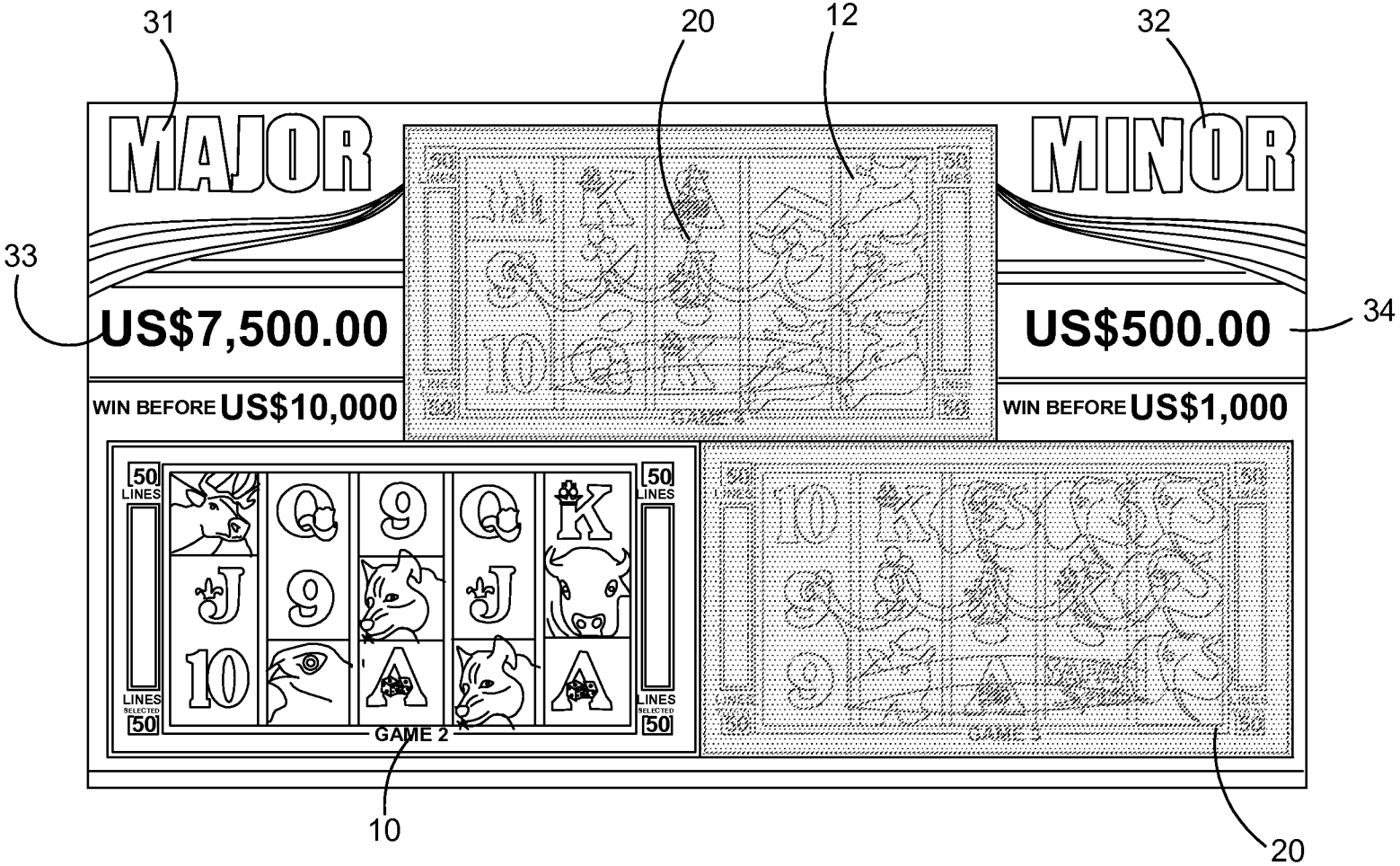
Figure 8:
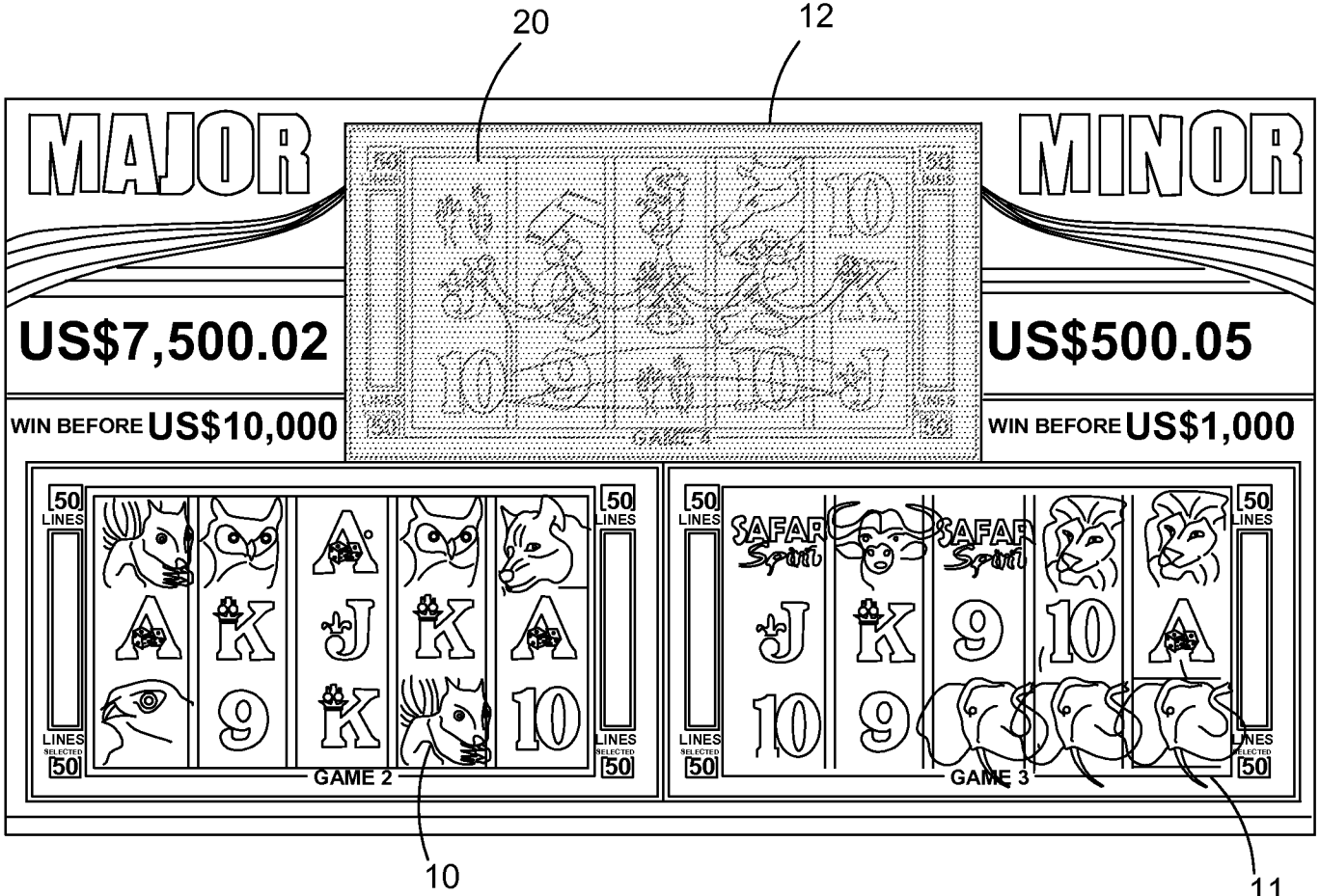

In addition, the player is able to select the number of base games 9, 10, 11, 12 are to be played at any one time, from one up to all four base games simultaneously. In this embodiment, the player is able to select the number of base games played simultaneously by betting on a number of pay lines 19, since each base game 9, 10, 11, 12 has a limited number of only 50 pay lines 19. For example, if the player bets or buys 50 pay lines 19, the electronic game controller 4 lets the player play the base game 9, which is illuminated to indicate that it is active, as best shown in FIG. 5. The remaining base games 10, 11, 12 are inactive and are "greyed out" by an image 20 to indicate its inactive status, as best shown in FIG. 5. Similarly, where the player bets or buys 100 pay lines 19, the electronic game controller 4 lets the player play two base games—the base games 9, 10, which are illuminated to indicate their active status while base games 11, 12 are greyed out by image 20, as best shown in FIGS. 4 and 6. If the player bets or buys 150 pay lines 19, the electronic game controller 4 lets the player play three base games—the base games 9, 10, 11, which are illuminated to indicate their active status while base game 12 is greyed out by image 20, as best shown in FIGS. 4 and 7. If the player bets or buys 200 pay lines 19, the electronic game controller 4 lets the player play all four base games 9, 10, 11 12, which are all illuminated to indicate their active status, as best shown in FIGS. 4 and 8. Any inactive base games 10, 11, 12 will spin with the player-selected base games and even show the results of each spin, but no prizes are awarded to the player for any predetermined winning combinations that may appear on the inactive base games 10, 11, 12. However, in an alternative embodiment, any inactive base games 10, 11, 12 do not spin and remain inactive for the duration of the activated base game(s) played until the electronic gaming machine 1 is reset.

Figure 10:
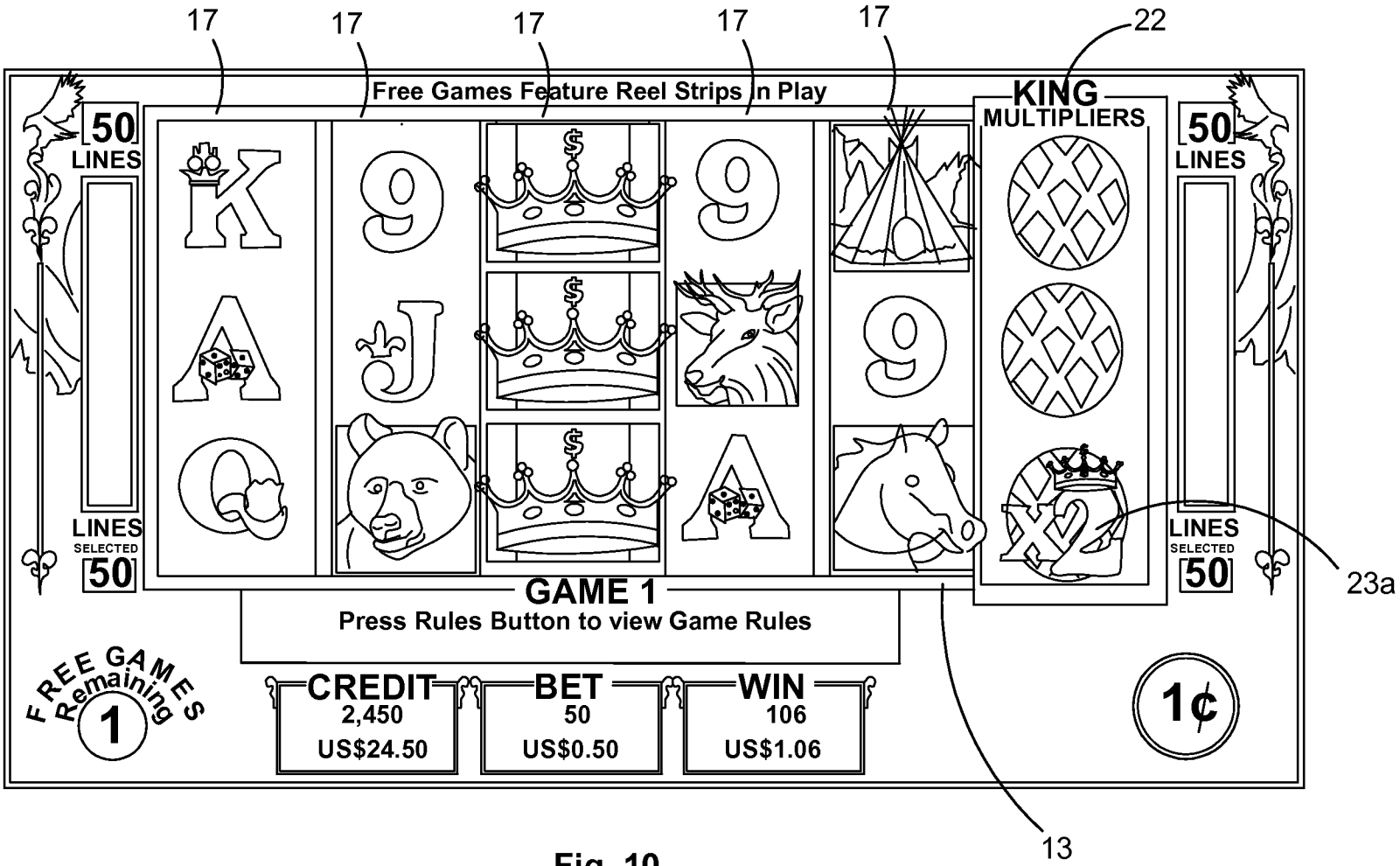
Figure 11:
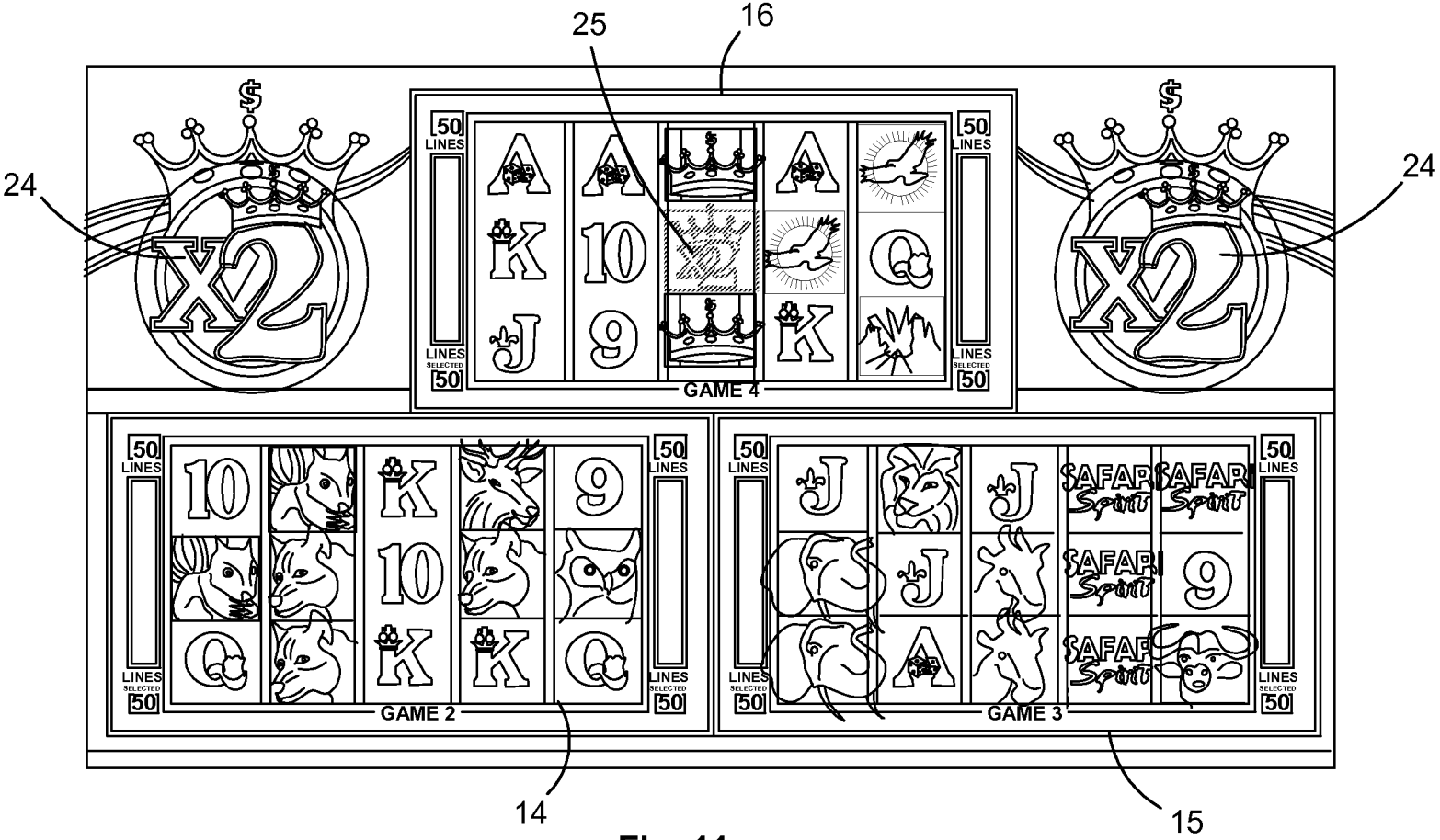
Figure 12:
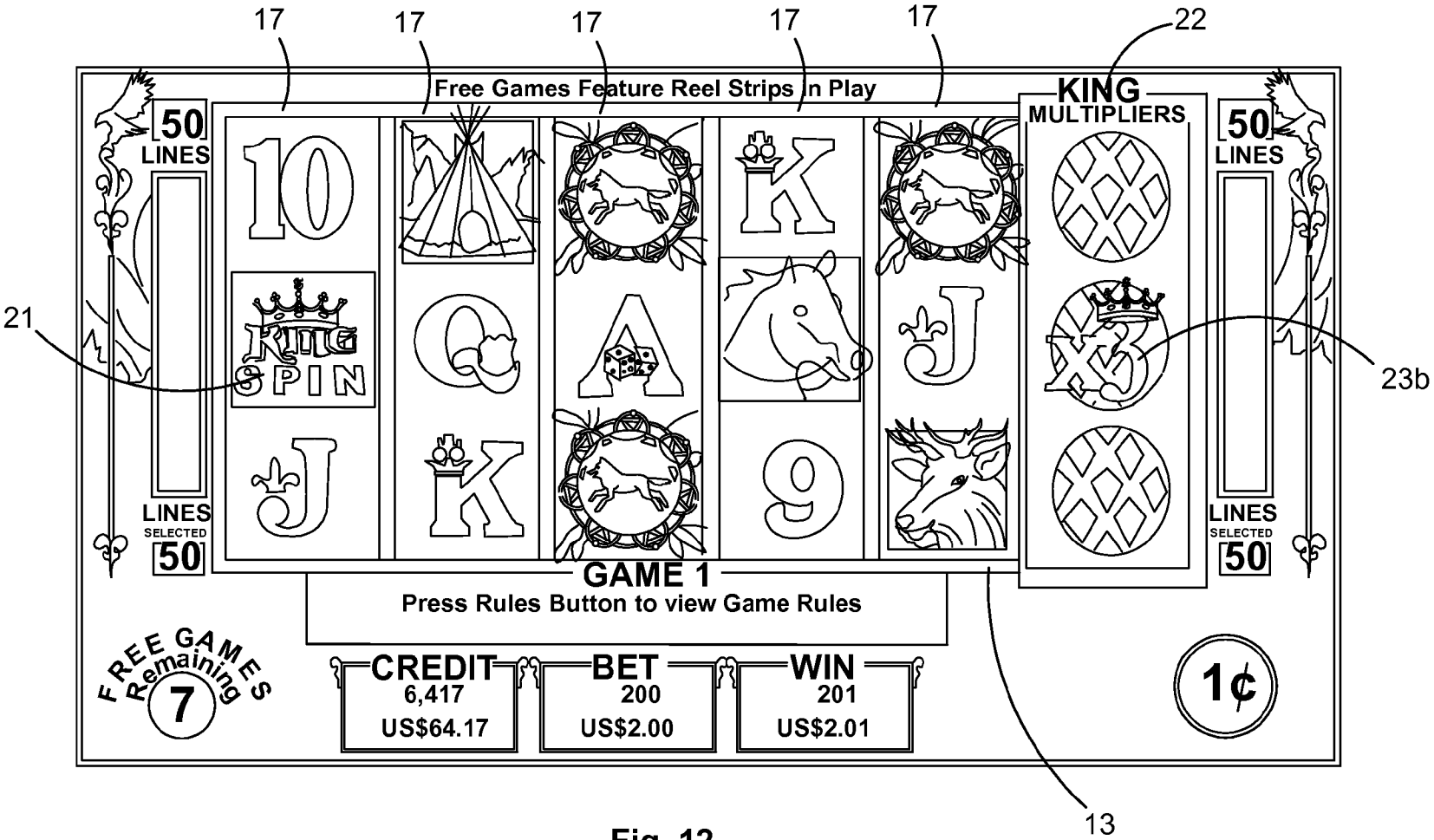
Figure 13:
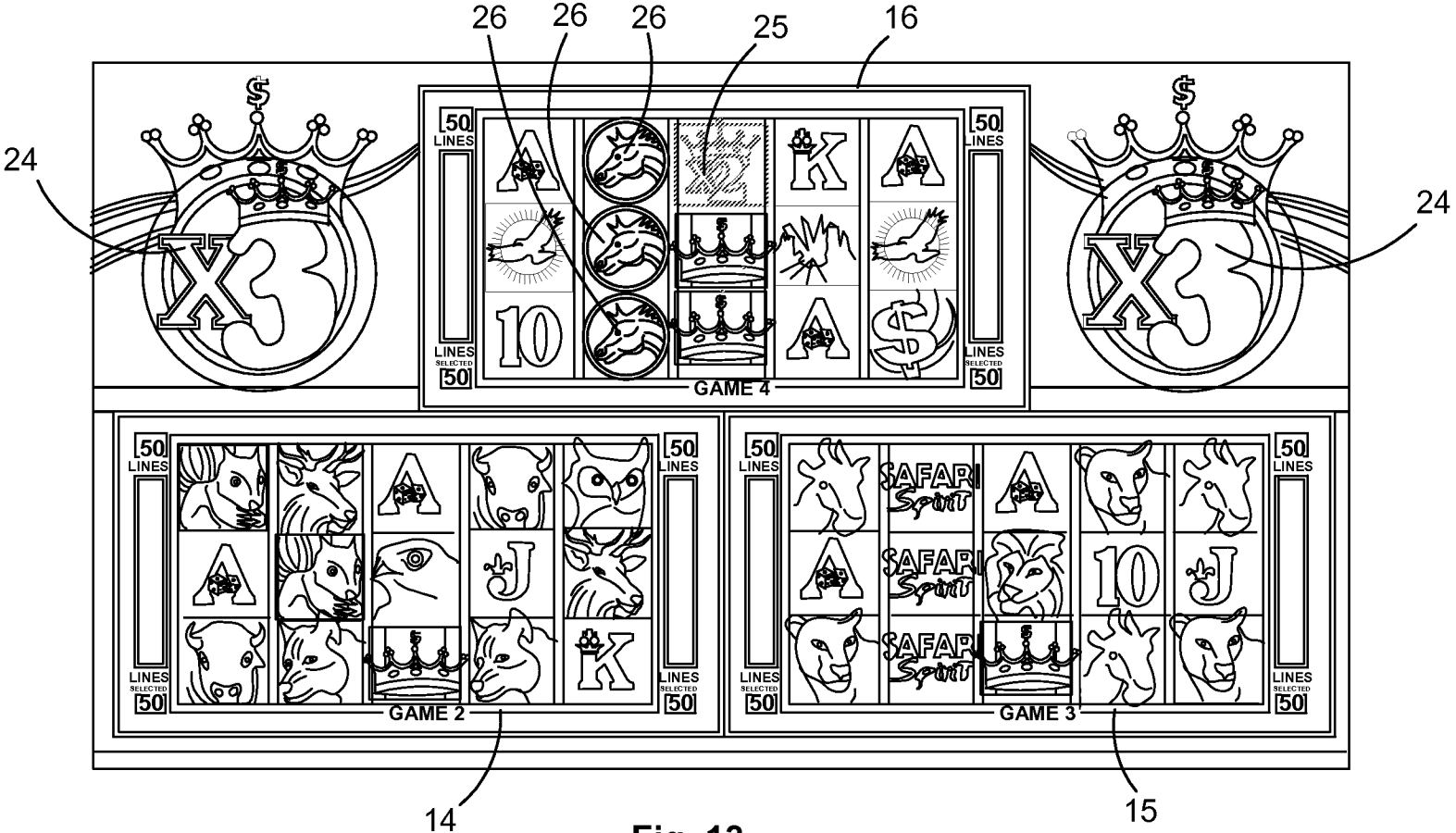
Figure 14:
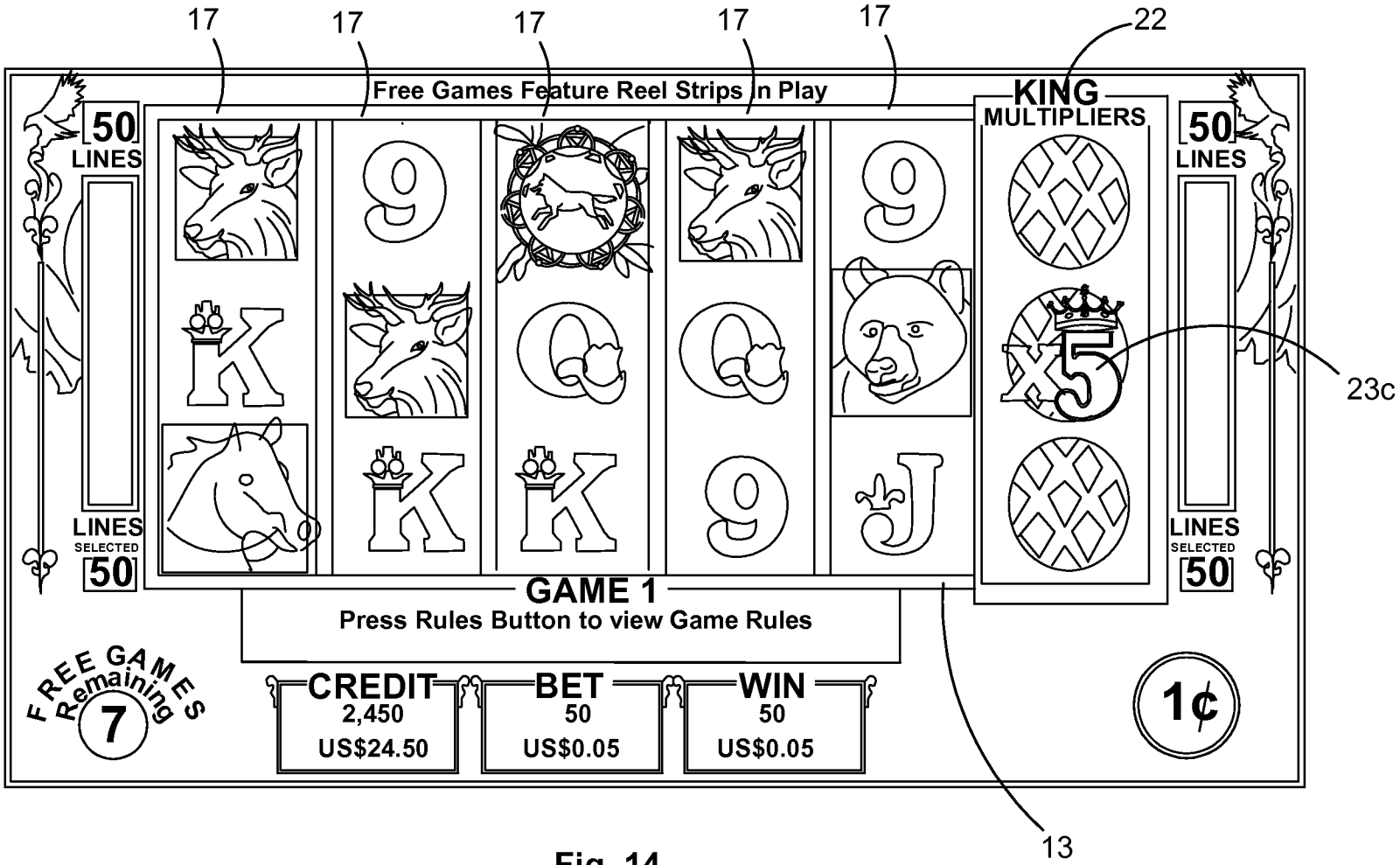

In response to a trigger event during play of the primary base game 9, the electronic game controller 4 causes the feature game 13 associated with the primary base game 9 in which the trigger event has occurred to appear on the display screen 7*a* for play, as best shown in FIGS. 10, 12 and 14. In addition, the feature game(s) 14, 15, 16 associated with the other player-selected base games 10, 11, 12 appear on the display screen 7*b* for simultaneous play with the feature game 13, as best shown in FIGS. 11, 13 and 15.

Figure 9:
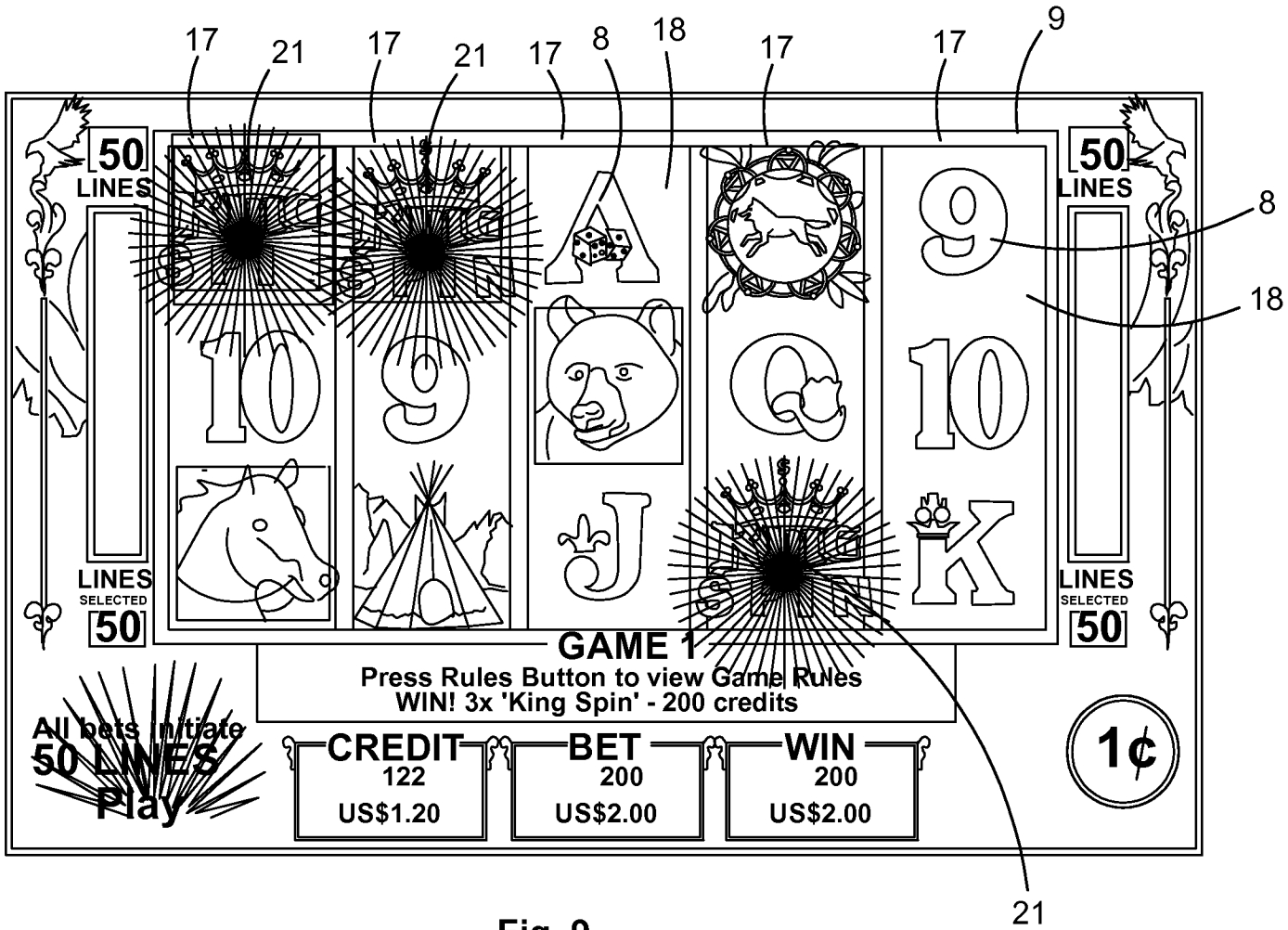

In this embodiment, the trigger event is the appearance of three trigger symbols in the form of the "King Spin" crown scatter symbols 21 in the reels 17 of the primary base game 9, as best shown in FIG. 9. Also in this embodiment, the feature games 13, 14, 15, 16 comprise game symbols 8 arranged in the same array of reels 17 as in the base games 9, 10, 11, 12. The game symbols 8 typically include picture symbols, wild symbols, scatter symbols and card symbols that are the same as the game symbols in the base game 9.

The feature games 13, 14, 15, 16 each comprise a predetermined number of free plays or spins of their respective reels 17. That is, the reels 17 in each feature game 13, 14, 15, 16 are spun without requiring the player to make a bet, unlike the base games 9, 10, 11, 12. In the feature games 13, 14, 15, 16, predetermined winning combinations of randomly selected game symbols 8 result in the award of prizes to the player. In this embodiment, the predetermined winning combinations of game symbols 8 can award the same prizes available in the base games 9, 10, 11, 12. Similarly, the electronic game controller 4 also controls the display of the game symbols 8 in the feature games 13, 14, 15, 16.

Figure 16:
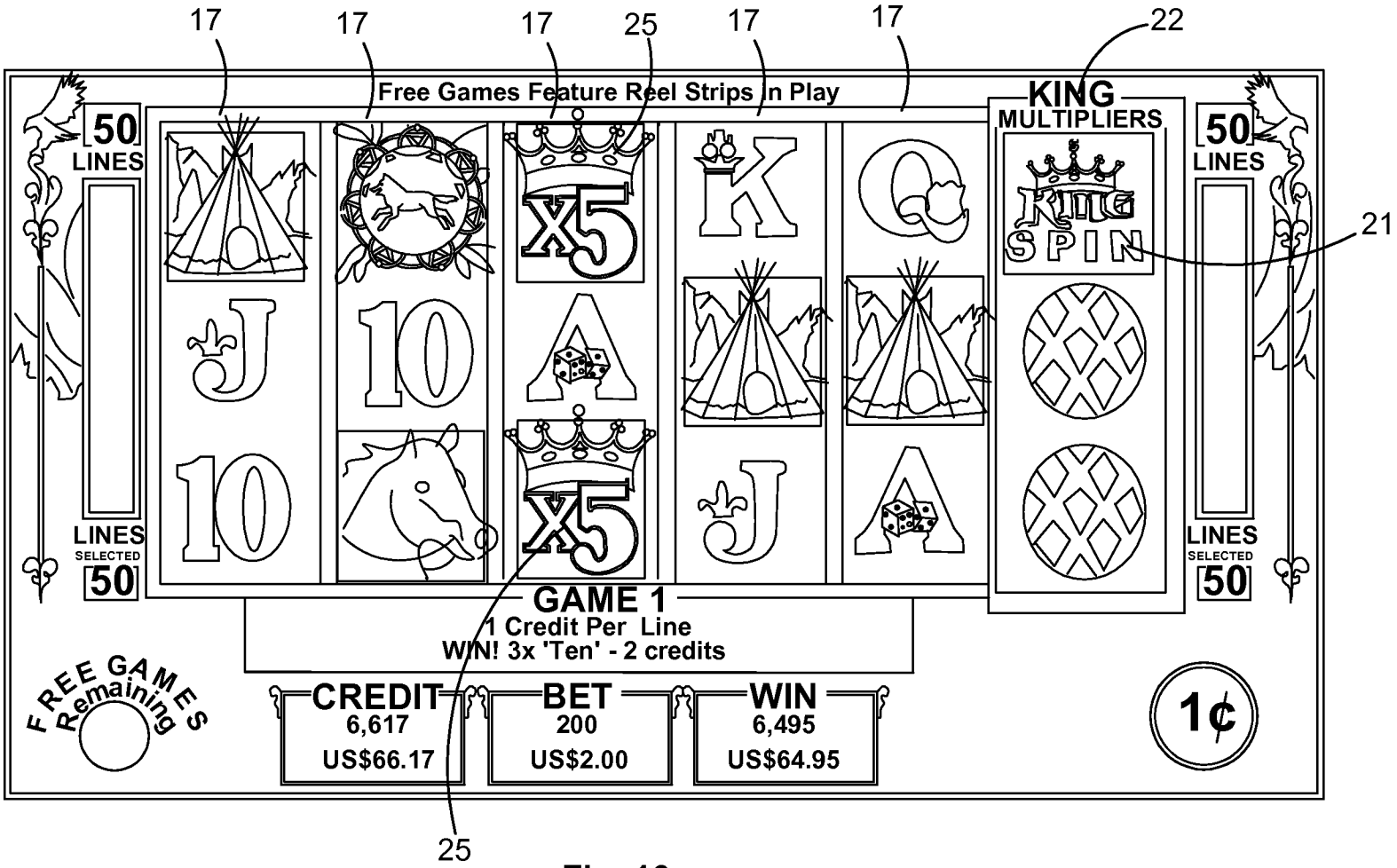

The feature game 13 is different to the other feature games 14, 15, 16 in that it also displays an extra or sixth reel 22, best shown in FIGS. 10, 12, 14 and 16. The sixth reel 20 randomly displays game symbols 8, including the "King Spin" crown symbols 21 as best shown in FIG. 16. The sixth reel also randomly displays special symbols that are each associated with a game enhancing element, and where the game enhancing element is applied to any prize that is awarded on any predetermined winning combinations of game symbols 8 that appear on the feature game 13. In this embodiment, the special symbol is in the form of a multiplier symbol 23, which is associated with a numerical value that multiplies the prize value by that numerical value. This numerical multiplier associated with the multiplier symbol 23 is also applied to any prizes that are awarded on any predetermined winning combinations of game symbols 8 that appear on any other active base games 10, 11, 12 or feature games 14, 15, 16. Thus, the numerical multiplier conferred by the multiplier symbol 23 is effectively applied to each player-selected game on the electronic gaming machine 1, thus increases the probability that the player will obtain prizes of higher value than just simply playing individual base or feature games on the electronic gaming machine. As a consequence, player excitement and interest is enhanced, encouraging the player to keep playing the electronic gaming machine 1.

Operation of this embodiment of the invention will now be described in more detail with reference to FIGS. 3 to 17. The player initially makes a bet using vending slots 5 initiate play of the electronic gaming machine 1. For example, the player can bet or wager 50 credits to play 10 pay lines or 200 credits to play 50 pay lines. The player selects and initiates play of the selected base games 9, 10, 11, 12, depending on the number of pay lines 19 that have been wagered by the player as discussed above. In this example, the player has bet the maximum number of 200 pay lines 19 and thus has selected all four base games 9, 10, 11, 12 to be played simultaneously on the electronic gaming machine 1. The electronic game controller 4 then causes the reels 17 to appear to visibly rotate or "spin", and randomly display the game symbols 8 for each base game 9, 10, 11, 12. Also, the player can make any additional side bets or ante-bets to access additional features in the base game, such as increasing the number of winning combinations in the base game.

After the reels 17 stop spinning, the controller 4 determines whether there are any predetermined winning combinations of the game symbols 8 appearing in any player-selected pay lines, such as a two of a kind, three of a kind, four of a kind or five of a kind. It will be appreciated that other winning combinations of game symbols 8 can also be provided. If there is a predetermined winning combination present in any of the selected base games 9, 10, 11, 12, the electronic gaming machine 1 enters a winning game state and awards a prize according to each displayed predetermined winning combination that appears on the selected base games 9, 10, 11, 12.

The electronic game controller 4 also determines the appearance of trigger crown symbols 21 in the primary base game, typically through a random determination. However, it will be appreciated that this determination need not be totally random as the electronic game controller 4 may switch to a reel strip having a greater probability of a trigger crown symbol 21 appearing where the feature game 13 has not be triggered for a predetermined number of plays of the primary base game 9.

Where the crown symbols 21 appear in the primary base game 9 (as best shown in FIG. 9), the feature games 13, 14, 15, 16 appear on the display screen 7*a*, 7*b* and are available for play. In the case of feature game 13, the extra or sixth reel 22 appears adjacent the rightmost reel 17, as best shown in FIGS. 10, 12, 14 and 16. The feature games 13, 14, 15, 16 then commence spinning simultaneously for a predetermined number of times without the player having to make a bet. During these free spins, the electronic game controller 4 determines the appearance of the multiplier symbol 23 on the extra reel 22.

In this embodiment, there are three different multiplier symbols 23, each of which is associated with different numerical values. For example, multiplier symbol 23*a* takes the form of an "×2" multiplier symbol to indicate its association with the number 2, as best shown in FIG. 10. Similarly, multiplier symbol 23*b* takes the form of an "×3" multiplier symbol to indicate its association with the number 3, as best shown in FIG. 12. Finally, multiplier symbol 23*c* takes the form of an "×5" multiplier symbol to indicate its association with the number 5, as best shown in FIG. 14.

The embodiment also includes two other different types of multiplier symbol in the "crown" multiplier symbols 25, as best shown in FIGS. 11, 13 and 16, and game-specific "coin" multiplier symbols 26, as best shown in FIGS. 13, 15 and 17. The KING crown multiplier symbols 25 are wild multiplier symbols in that they act as wild symbols for any predetermined winning combinations containing the game position 18 occupied by the crown symbol 25. However, the crown symbol 25 is limited to the feature game(s) 13, 14, 15, 16 in which it appears and is not applied to the other player-selected feature games. Also, in this embodiment, the crown symbol 25 only appears in the middle reel and is associated with ×2, ×3 and ×5 multiplier values. The coin multiplier symbol 26 also only applies to predetermined winning combinations containing the game position 18 occupied by the coin symbol 26 in the feature game(s) 14, 15, 16 in which it appears. The coin multiplier symbol 26, like the wild multiplier symbol 25, does not apply to the predetermined winning combinations that appear on the other player-selected feature games.

The multiplier symbols 23 increase the value of any prizes awarded for predetermined winning combinations appearing on the reels 17 during any of the free spins of the player-selected feature games 13, 14, 15, 16 by multiplying the value of the prize by the associated number. For example, where a "×3" symbol 23*b* appears in the sixth reel 22, as shown in FIG. 12, any prizes that are awarded for predetermined winning combinations on the player-selected feature games 13, 14, 15, 16 on conclusion of the same spin as the sixth reel showing the "×3" multiplier symbol 23*b* are immediately multiplied by 3 to increase their value, as best shown in FIG. 13. Similarly, where the sixth reel 22 shows an "×2" multiplier symbol 23*a* (as shown in FIG. 10) or an "×5" multiplier symbol (as shown in FIG. 14), then the prizes that are awarded for predetermined winning combinations on the player-selected feature games 13, 14, 15, 16 will be multiplied by 2 and 5, respectively, as best shown in FIGS. 11 and 15. This multiplier effect continues for all subsequent free spins until the player-selected feature games 13, 14, 15, 16 are completed, unless further free spins are triggered during game play of the feature games. Thus, the increased value of the prize increases the player's excitement and enhances his or her interest in playing the electronic gaming machine 1.

Where a multiplier symbol 23 does not appear in the sixth reel 22, then the feature games 13, 14, 15, 16 continue with their free spins. For example, as best shown in FIG. 16, a crown trigger symbol 21 has appeared in the sixth reel 22. However, this does not affect the other feature games 14, 15, 16 as best shown in FIG. 17, and they continue spinning their own outcomes without being affected by the crown trigger symbol 21.

The application of this multiplier effect to the player-selected feature games 13, 14, 15, 16 is indicated to the player by images 24 associated with the multiplier number being shown on the display screen 7*b*, as best shown in FIGS. 11, 13, and 15. The images 24 convey to the player the association of the relevant "×2" multiplier symbol, "×3" multiplier symbol and "×5" multiplier symbol with the player-selected feature games 13, 14, 15, 16. The multiplier symbol 23 is otherwise not displayed as an individual symbol on the array of each player-selected feature games 14, 15, 16 on the display screen 7*b*.

Where the player make a bet on a lesser number of pay lines 19 such that one or more of the base games 9, 10, 11, 12 are inactive, when the crown symbols 21 appear in one of the player-selected games, the inactive base game(s) remain inactive and their corresponding feature game(s) are not triggered. Similarly, any multiplier symbols 23 appearing on the extra reel 22 do not apply to the inactive base game(s).

Once all the free spins have been played in the feature games 13, 14, 15, 16, the electronic game controller 4 returns the electronic gaming machine 1 to displaying the base games 9, 10, 11, 12 on display screens 7*a*, 7*b*. The electronic gaming machine 1 will await for the player to select the number of base games to be played via the wagered amount and for the trigger event to occur in a play of the base game 9 before proceeding to activate the feature games 13, 14, 15 16 for the player-selected base games.

When the player initially plays the electronic gaming machine, the upper display screen 7*b* shows a general logo image 30 representing the "King Spin" game, as best shown in FIG. 17. The general logo image 30 is also displayed where the multiplier effect is not applied to the player-selected feature games 13, 14, 15, 16. In addition, jackpot information relating to a major jackpot 31 and a minor jackpot 32, with their associated monetary amounts 33, 34 are also shown both before and during game play, as best shown in FIGS. 5 to 8.

In another preferred form, the different multiplier symbols 23*a*, 23*b*, 23*c* can appear at the same time on the extra reel 22 and as a result are combined to confer a cumulative numerical value that is applied to all the prizes awarded in the player-selected feature games 13, 14, 15, 16.

In other preferred forms, the invention is implemented using other game symbols that are associated with different numerical values, thus having a similar effect to the multiplier symbols 23 in the preferred embodiment. These game symbols having associated numerical values that are applied to prizes awarded in the player-selected feature games include a wild multiplier symbol, a wheel with numerous multipliers or free game values as outcomes, a jackpot level value, a bonus prize value or any other such numerical application. For example, a bonus credit symbol associated with one or more credit values, such as 50, 100, 150 and 200 credits, may be used instead so that any prize that is awarded during the feature games 13, 14, 15, 16 is increased by the amount of the associated credit value. Similarly, a wheel symbol results in a wheel having various numerical values being "spun" and the resulting numerical value awarded at the end of the wheel spin is multiplied or added to the prize. Likewise, one or more "free games" symbols award 5, 8 or 10 free games on each player-selected feature game. The jackpot level symbol would increase the value of any jackpot by a single level that can be won during play of the player-selected feature games 13, 14, 15, 16.

Also, in other preferred forms, the invention is implemented using game symbols that are associated with game enhancing elements that do not necessarily have a numerical value but instead have a different effect on the player-selected feature games 13, 14, 15, 16. For example, the game enhancing elements comprise at least one or more of a second array, bonus prizes, collector symbols, bonus wilds, trigger symbols to retrigger the second array, held columns, random wild symbols, progressives, jackpot symbols, and one or more symbol replacements.

Held columns or reels typically involve the column or reel to only display wild card symbols, thus enhancing the probability of achieving a predetermined combination. Jackpot symbols typically award a jackpot prize after accumulating a predetermined number of jackpot symbols over a number of games that are played. Progressives operate in a similar manner to jackpot symbols in that a prize is awarded upon a certain number of progressive symbols are accumulated by the player over a number of games played on the gaming machine.

While preferred embodiment has been described as having the trigger event in the primary base game 9 causing all the player-selected feature games 13, 14, 15, 16 to be activated, it will be appreciated that in other embodiments, the feature games 13, 14, 15, 16 each have to be activated individually in their respective base games 9, 10, 11, 12. In this case, the multiplier effect in the primary feature game 13 is applied to the player-selected base games 10, 11, 12 where their associated feature games 14, 15, 16 have not been activated yet.

In another embodiment of the invention, the trigger event is not limited to occurring during play of the primary base game 9, but can occur in any of the player-selected base game(s) 9, 10, 11 12 and not just the primary base game 9. In this case, the electronic game controller 4 causes the feature game 13, 14, 15, 16 associated with the base game in which the trigger event has occurred to appear on the display screen 7*a*, 7*b* for play, and the extra reel 22 would appear in the feature game associated with the base game in which the trigger event occurred.

In a further embodiment, each of the player-selected feature games 13, 14, 15, 16 would have an extra reel 22 in which the multiplier symbol 23 (or other special game symbol having an associated game enhancing element or numerical value as described above) may appear. In this case, any special symbols that appear at the same time on the extra reels 22 would result in their respective game enhancing elements and/or numerical values being applied simultaneously to each of the player-selected feature games 13, 14, 15, 16.

In one preferred form, the invention is implemented in only the base games 9, 10, 11, 12, rather than using feature games 13, 14, 15, 16. In this preferred form, the base game would generally operate as described above in relation to FIGS. 3 to 17, but the game enhancing element or numerical value conferred by the special symbols would take effect in a subsequent play of the base game, typically the next spin or play of the player-selected base games 9, 10, 11, 12. Likewise, the invention can be implemented as a feature game only, so that the trigger event only occurs in the player-selected feature games and the game enhancing element or numerical value conferred by the special symbols would take effect in a subsequent play of the player-selected feature games 13, 14, 15, 16. It will be appreciated that the subsequent play need not be a successive play, but could be later in a sequence of plays of the base game or feature game.

Whilst the preferred embodiment has been described wherein the trigger event causes the electronic game controller 4 to trigger the feature games 13, 14, 15, 16 in each of the player-selected base games 9, 10, 11, 12, it will be appreciated that in other embodiments, the feature game is only triggered for the base game in which the trigger event has occurred. Thus, the other player-selected base games would need to have their feature games triggered. In either event, the game enhancing element or numerical value would be applied to the player-selected base game(s) or feature game(s) for the duration of the spins of the feature game which was initially triggered by the trigger event.

In the further preferred form, the player is also able to select the base game 9, 10, 11, 12 as the primary base game featured on the lower display screen 7*a*. In this case, the base game selected as the primary base game (for example, base game 10) would appear on the lower display screen 7*a* and the other base games 11, 12 would shift, rotate or otherwise move to accommodate the base game 9. Alternatively, the base game 9 would take over the position of base game 10 on the upper display screen 7*b*.

In another preferred form, the plays or spins need not be free as described in the preferred embodiment. Rather, the player may be required to make a further bet in order to play the spins in which the reels are selected and reselected with a new reel. Alternatively, where the invention is implemented in a set of base games 9, 10, 11, 12, the player makes a bet for each spin as in a conventional base game.

It will be appreciated that the invention also includes other types of associations between the prize value increase and the numerical values. For example, the prize value could be increased by simply adding the numerical value to the prize value. Another type of association involves increasing the prize value by replacing or supplementing one of the digits of the prize value. For example, a numerical value of 3 is associated with a special symbol and a prize value of, say, 250 credits could be increased by adding the number 3 into the prize value number to create increased prize values of 2503, 2530, 2350 and 3250 credits. Using the same example, the number 3 could replace the first digit to create an increased prize value of 350 credits.

Also, the arrangement of the base games 9, 10, 11, 12 and the feature games 13, 14, 15, 16 is not limited to a set of reels or columns, but could take other forms, such as non-rectangular arrays (i.e. arrays that do not comprise rows and columns). For example, where the array is circular, the predetermined game positions can take the form of pie-shaped slices or wedges.

While the same game format is essentially used across the base games 9, 10, 11, 12 and feature games 13, 14, 15, 16, it will be appreciated that the game format may vary across both base games and feature games. For example, the base game 9 may be a wheel-type game or a four reel game and its corresponding feature game 13 may be a standard five reel game. In another example, the change in format is between the base games 9, 10, 11, 12 in that one base game has five reels and another base game is a wheel-type game. Likewise, the change in format is between the feature games 13, 14, 15, 16. Similarly, the base games 9, 10, 11, 12 and feature games 13, 14, 15, 16 may each have different game symbols, game rules and pay tables that are unique to each game.

Also, in another preferred form, there is no need for a trigger event in the form of the appearance of a predetermined number of trigger symbols. Instead, the electronic game controller 4 can internally determine when to trigger the feature game(s) in the player-selected base games. One way to implement this preferred form is for the electronic game controller 4 to internally generate a random number and checks if it is a predetermined number or within a predetermined range of numbers that will initiate the appearance of the feature game(s) 13, 14, 15, 16 for the player-selected base games 9, 10, 11, 12. For example, the predetermined range of numbers could be the range of numbers between 1 and 10 and the electronic game controller 4 internally generates a random number between 1 and 100. If the generated number is any one of numbers 1 to 10, then this results in the electronic game controller 4 causing the trigger event to occur in the primary base game 9 and activating the feature game(s) 13, 14, 15, 16.

While the embodiment of the invention has been described in relation to a base game and a feature game, it will be appreciated that the invention could include one or more additional feature games that are triggered by specific trigger symbols appearing in the feature games 13, 14, 15, 16. Also, the additional feature games may also have trigger symbols that trigger further feature games in a cascading fashion. These additional and further feature games could have the same game play elements as the feature games 13, 14, 15, 16 or be different feature games entirely. In a particularly preferred embodiment, the triggering of additional feature games in the primary feature game 13 also triggers additional feature games in the other player-selected feature games 14, 15, 16. The trigger symbols can include a particular predetermined winning combination appearing in the feature game 13.

Also, in a further preferred form, the player can selectively stop spinning of the reels 17 in the base games 9, 10, 11, 12 and feature games 13, 14, 15, 16 to increase player interaction. Furthermore, the player can start spinning of the reels 17 in the base games 9, 10, 11, 12 and feature games 13, 14, 15, 16 to further enhance player interaction.

In other preferred forms, the base games 9, 10, 11, 12 and feature games 13, 14, 15, 16 are displayed on a single display screen, rather than being divided into two separate display screens 7*a*, 7*b*

In another preferred form, the video display screens 7*a*, 7*b* is a touch screen for use in addition to the player-actuatable buttons 6 so as to enable the player to select various features, such as making monetary bets for the game and responding to any messages or requests issued on the electronic gaming machine 1 by the electronic game controller 4. In this case, the player may control when the reels 17 start spinning and stop spinning in any of the base games 9, 10, 11, 12 and feature games 13, 14, 15, 16 by simply touching the relevant reel 17.

In yet a further preferred form, the primary base game 9 uses the multiplier symbols 23 as trigger symbols, effectively replacing the crown trigger symbols 21. In this case, any multiplier symbols 23 that appear on the reels 17 trigger the feature games 13, 14, 15, 16 but does not cause the multiplier effect to apply until a further multiplier symbol appears in one of the free spins on the extra reel 22.

It will be appreciated that while the preferred embodiments have been described in relation to an industry standard electronic gaming machine, the invention can be readily applied to other types of electronic gaming machines, including a personal computer (standing alone or connected to a communications network, LAN or WAN), mobile electronic devices (such as handheld or portable electronic devices) and other electronic devices capable of displaying a game. In the case of mobile electronic device, in one arrangement it may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during gameplay. An alternative arrangement would require the player to purchase virtual credits or tokens via an interface on the mobile electronic device or an online interface accessible by the mobile electronic device. Similarly, either of the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In another aspect, the invention includes a computer program configured to perform the invention. In this way the invention can be implemented in various ways on an electronic gaming machine. In a further aspect, the invention includes a computer system configured comprising a central processing unit configured for communication with an electronic gaming machine to perform the invention. In a yet another aspect, the invention includes a non-transitive carrier medium carrying computer executable code that, when executed on a central processing unit configured for communication with an electronic gaming machine, causes said central processing unit to perform the invention. In this case, the non-transitive carrier medium includes an external hard drive, a memory device, including a memory card, smart card, a radio frequency identification (RFID) device, USB key, magnetic card or other electronic storage device.

It will further be appreciated that any of the features in the preferred embodiments of the invention can be combined together and are not necessarily applied in isolation from each other. For example, the feature of not have a specific trigger event can be readily combined with the feature of each player-selected feature game having the extra reel 22.

By providing a set of player-selectable games with a feature game that uses special symbols with associated game enhancing elements, including numerical values, to provide increases in the value of prizes based on winning combinations appearing in any of the player-selected games, the invention increases player excitement and thus interest in the player-selected games, thus encouraging the player to continue playing the same electronic gaming machine. Furthermore, the indication of the special symbols appearing in an extra reel enhances the player's anticipation during plays or spins of the player-selected feature game, as the player knows that the appearance of a special symbol in the extra reel means that any prizes awarded on winning combinations on any of the player-selected games are significantly increased. All these advantages of the invention result in the player being more likely to retain interest in continuing to play the same electronic gaming machine. Furthermore, since the electronic game controller controls operation of the base game and feature game, the invention can be readily implemented to existing gaming machines and other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. An electronic gaming machine comprising:

a display for displaying a plurality of games, wherein each game comprises game symbols arranged into an array and where predetermined winning combinations of randomly selected game symbols in each game award prizes to a player, vending slots for receiving monetary bets, and an electronic game controller being adapted to determine if a bet has been made using the vending slots to initiate play of said games and to control the display of game symbols on the display if a bet has been received, wherein said player selects the number of said games that are simultaneously playable, said electronic game controller determining if winning combinations of randomly selected game symbols have occurred in said player-selected games and awarding prizes to the player for every winning combination in each game, said electronic game controller determining the appearance of one or more special symbols in a first game of said player-selected games, wherein said one or more special symbols each have an independent effect on said first game, and the appearance of at least one special symbol in said first game causes said electronic game controller to apply the effect of the one or more special symbols to each of said player-selected games without displaying said at least one special symbol in each of said player-selected games, said first game comprising a base game and a feature game, wherein said one or more special symbols appear in said feature game.

2. The electronic gaming machine of claim 1, wherein the effect is to increase the value of any prizes awarded upon any predetermined winning combinations appearing in said player-selected games.

3. The electronic gaming machine of claim 2, wherein the effect comprises a numerical value and said increase is associated with said numerical value.

4. The electronic gaming machine of claim 3, wherein the effect comprises at least one of a multiplier symbol; an all wins multiplier symbol which applies to all predetermined winning combinations; a wild multiplier symbol which applies to predetermined winning combinations that include the wild multiplier symbol; a wheel with two or more numerical values where the electronic game controller randomly selects one of the numerical values on said wheel for application to said player-selected games; a free game symbol with an associated numerical value representing the number of additional free games awarded to said player; a symbol associated with a jackpot level value; a bonus prize value, and a numerical enhancement of said prize(s).

5. The electronic gaming machine of claim 1, wherein the effect comprises adding at least one or more of a second array, bonus prizes, collector symbols, bonus wilds, trigger symbols to retrigger the second array, held columns, random wild symbols, progressives, jackpot symbols, one or more symbol replacements and additional plays of feature games.

6. The electronic gaming machine of claim 1, wherein more than one special symbol appears in said first game, the effect associated with each special symbol is applied simultaneously to each of said player-selected games.

7. The electronic gaming machine of claim 1, wherein the effect is immediately applied to any predetermined winning combinations in said player-selected games.

8. The electronic gaming machine of claim 1, wherein the effect is applied to said player-selected games for one or more subsequent plays of said player-selected games after an initial play of said first game in which said at least one special symbol has appeared.

9. The electronic gaming machine of claim 1, wherein said feature game comprises additional game symbols displayed adjacent to said array of said first game.

10. The electronic gaming machine of claim 9, wherein said array of said first game comprises an array of rows and columns and said additional game symbols are displayed as an extra row or column, said one or more special symbols also being displayed in said extra row or column.

11. The electronic gaming machine of claim 1, wherein the number of player-selected games is dependent on the amount wagered by said player.

12. The electronic gaming machine of claim 1, wherein the number of player-selected games is dependent on the number of pay lines that are wagered by said player.

13. An electronic gaming machine comprising:

a display for displaying a plurality of games, wherein each game comprises game symbols arranged into an array and where predetermined winning combinations of randomly selected game symbols in each game award prizes to a player, vending slots for receiving monetary bets, and an electronic game controller being adapted to determine if a bet has been made using the vending slots to initiate play of said games and to control the display of game symbols on the display if a bet has been received, wherein said player selects the number of said games that are simultaneously playable, said electronic game controller determining if winning combinations of randomly selected game symbols have occurred in said player-selected games and awarding prizes to the player for every winning combination in each game, said electronic game controller determining the appearance of one or more special symbols in a first game of said player-selected games, wherein said one or more special symbols each have an independent numerical value by which prizes awarded during said first game are multiplied, and the appearance of at least one special symbol in said first game causes said electronic game controller to multiply prizes awarded during each of said player-selected games by the numerical value of the one or more special symbols without displaying said at least one special symbol in each of said player-selected games, said first game comprising a base game and a feature game, wherein said one or more special symbols appear in said feature game.

14. The electronic gaming machine of claim 13, wherein said numerical value increases the value of any prizes awarded upon any predetermined winning combinations appearing in said player-selected games.

15. The electronic gaming machine of claim 14, wherein said increase is associated with said numerical value.

16. The electronic gaming machine of claim 13, wherein more than one special symbol appears in said first game, the numerical values associated with each special symbol are applied simultaneously to each of said player-selected games.

17. The electronic gaming machine of claim 13, wherein said numerical value is applied to said player-selected games for one or more subsequent plays of said player-selected games after an initial play of said first game in which said at least one special symbol has appeared.

18. The electronic gaming machine of claim 13, wherein the association of said numerical value with said player-selected games is indicated on said display.

19. The electronic gaming machine of claim 13, wherein said feature game comprises additional game symbols displayed adjacent to said array of said first game.

20. The electronic gaming machine of claim 19, wherein said array of said first game comprises an array of rows and columns and said additional game symbols are displayed as an extra row or column, said one or more special symbols also being displayed in said extra row or column.

21. The electronic gaming machine of claim 13, wherein the number of player-selected games is dependent on the amount wagered by said player.

22. The electronic gaming machine of claim 13, wherein the number of player-selected games is dependent on the number of pay lines that are wagered by said player.

* * * * *